US006782236B2

(12) United States Patent
Sasaki et al.

(10) Patent No.: US 6,782,236 B2
(45) Date of Patent: Aug. 24, 2004

(54) DUPLEX IMAGE FORMING APPARATUS

(75) Inventors: Ichiro Sasaki, Ibaraki (JP); Keizo Isemura, Tokyo (JP); Manabu Yamauchi, Chiba (JP); Hiroto Nishihara, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 95 days.

(21) Appl. No.: 10/247,307

(22) Filed: Sep. 20, 2002

(65) Prior Publication Data

US 2003/0063936 A1 Apr. 3, 2003

(30) Foreign Application Priority Data

Oct. 2, 2001 (JP) ..... 2001-306295
Oct. 2, 2001 (JP) ..... 2001-306296

(51) Int. Cl.[7] ..... G03G 15/00

(52) U.S. Cl. ..... 399/401; 399/364; 399/297; 271/184; 271/185; 271/902

(58) Field of Search ..... 399/401, 364, 399/369, 388, 397; 271/184, 185, 902, 188

(56) References Cited

U.S. PATENT DOCUMENTS

| | | | | |
|---|---|---|---|---|
| 4,573,789 A | | 3/1986 | Wada | 355/14 |
| 4,853,740 A | | 8/1989 | Ushio et al. | 355/319 |
| 5,086,320 A | * | 2/1992 | Koike | 399/401 |
| 5,689,759 A | | 11/1997 | Isemura et al. | 399/45 |
| 5,815,280 A | | 9/1998 | Ohmura et al. | 358/296 |
| 5,815,786 A | | 9/1998 | Isemura | 399/376 |
| 5,940,543 A | | 8/1999 | Isemura et al. | 382/284 |
| 6,317,581 B1 | * | 11/2001 | Boehmer et al. | 399/401 |
| 6,325,585 B1 | | 12/2001 | Sasaki et al. | 412/11 |
| 6,330,422 B1 | | 12/2001 | Sato et al. | 399/382 |
| 6,470,169 B2 | * | 10/2002 | Nakazato | 399/388 |
| 6,549,748 B2 | * | 4/2003 | Miura | 399/401 |
| 6,615,018 B2 | * | 9/2003 | Funato | 399/322 |
| 6,647,243 B2 | * | 11/2003 | Sato et al. | 399/407 |

FOREIGN PATENT DOCUMENTS

| | | |
|---|---|---|
| JP | 58-182655 | 10/1983 |
| JP | 62-161641 | 7/1987 |
| JP | 6-35265 | 2/1994 |
| JP | 2000-143103 | 5/2000 |

* cited by examiner

*Primary Examiner*—Andrew H. Hirshfeld
*Assistant Examiner*—Dave A. Ghatt
(74) *Attorney, Agent, or Firm*—Fitzpatrick, Cella, Harper & Scinto

(57) ABSTRACT

An image forming apparatus reverses a sheet, on one side of which an image has been formed in an image forming section, transports the sheet back to the image forming section, and forms an image on the other side of the sheet, the apparatus has an inlet feed path for transporting a sheet, on one side of which an image has been formed; a switch-back path for withdrawing the sheet transported from the inlet feed path; a plurality of reverse feed paths branching from the switchback path at plural positions, each of the reverse feed paths transporting a sheet while reversing the sheet; and a re-feed path for transporting the reversed sheet from any of the reverse feed paths back to the image forming section.

29 Claims, 19 Drawing Sheets

108
S1
210A
210B
SPACE
109
211B
117
116
109A
R6
R7
B1
3
R61
214A
R1
212B
211A
8
R62
212A
5
7
214C
214B
SPACE
6
4
R4
115a
220A
220B
221
R5
R8
R9
R3

108
S1
109
210A
210B
3
7
B1
211B
117
116
SPACE
211A
R6
R7
R61
214A
109A
8
R1
212B
R62
212A
5
7
214C
R3
B2
6
4
R4
115a
220A
214B
221
R5
220B
R8
R9

SPACE
108
109
R62
211B
117
116
B1
B2
R61
S4
R6
R7
214B
211A
R1
212B
214A
109A
8
212A
5
7
214C
R3
SPACE
6
4
R4
115a
220A
220B
221
R5
R8
R9

108
109
210A
S1
210B
SPACE
B2
211B
117
116
SPACE
109A
211A
R61
R6
R7
214B
R1
212B
R62
214A
S3
B1
5
7
B3
214C
R3
6
4
115a
R4
220A
220B
221
R5
R8
R9

109A
108
210A
109
SPACE
210B
211B
117
116
R61
B1
B3
R6
R7
R62
214A
B2
8
R1
212B
S4
212A
5
7
SPACE
214C
R3
6
4
R4
220A
214B
220B
221
R5
R8
R9

S1
108
210B
210A
R62
SPACE
B3
211B
117
116
109A
SPACE
R61
R6
R7
214B
R1
211A
8
214A
212B
S3
B2
5
7
SPACE
214C
R2
R3
6
4
R4
220A
220B
221
R5
R8
R9

DUPLEX IMAGE FORMING APPARATUS

BACKGROUND OF THE INVENTION

1. Field of the Invention

The present invention relates to an image forming apparatus capable of forming images on both front and rear sides of a sheet.

2. Description of the Related Art

Hitherto, in some of image forming apparatuses such as copying machines and page printers, after reversing a sheet having an image formed on one (front) side, the sheet is transported again to an image forming section to form an image on the other (rear) side. Such an image forming apparatus includes a duplex feed unit for reversing a sheet having an image formed on one side, and then transporting the sheet again to the image forming section. That duplex image formation, however, has a problem in that the efficiency is reduced in a continuous image forming mode because a sheet is circulated. The following techniques have been proposed as measures for overcoming the problem.

For example, a duplex feed unit disclosed in Japanese Patent Laid-Open No. 58-182655 includes a duplex copying aid means that comprises a sheet ejection section, a switching gate, a switchback section, a return section, and a reversing section. When copying an image on the rear side of a sheet on the front side of which an image has been copied, the duplex copying aid means increases a copy return speed so that the sheet having finished copying of an image on the front side more quickly reaches a predetermined return position from which copying of an image on the rear side can start. As a result, the efficiency of duplex copying can be increased.

Also, a duplex feed unit disclosed in Japanese Patent Laid-Open No. 62-161641 includes a feed control means for adjusting the interval in supply of sheets, on each of which images are to be formed on duplexs or in a superimposed manner, depending on feed conditions of the sheets or an external means. The feed control means operates to prevent a reduction of the maximum number of sheets printable per minute in a continuous printing mode.

Further, the duplex feed unit disclosed in Japanese Patent Laid-Open No. 6-35265 includes two stages of sheet reversing routes each having a reversing feed path. With this unit, continuously transported sheets can be consistently supplied again without stopping the sheets, and hence duplex image formation can be performed at a higher speed.

Moreover, in the duplex feed unit disclosed in Japanese Patent Laid-Open No. 2000-143103, a plurality of branched reversing sections are provided in a re-feed path, and sheets successively transported at a predetermined interval are introduced to the respective reversing sections and reversed therein. Then, the sheets are transported again to an image forming section at a sheet interval narrower than the predetermined interval, whereby a speed of duplex image formation can be increased.

However, the image forming apparatuses including those conventional duplex feed units have the problems given below.

In the apparatus including the duplex feed unit to increase the speed in transporting a sheet, on one side of which an image has been printed, to a reversing unit as disclosed in Japanese Patent Laid-Open No. 58-182655, or in the apparatus including the duplex feed unit to adjust the interval in supply of sheets depending on feed conditions of the sheets as disclosed in Japanese Patent Laid-Open No. 62-161641, a great improvement in processing speed cannot be expected even though a slight increase in speed of the duplex image formation is expected.

Also, in the apparatus including the duplex feed unit provided with two stages of sheet reversing routes each having a reversing feed path as disclosed in Japanese Patent Laid-Open No. 6-35265, the apparatus size is increased and the feed path has a larger length. Hence, the sheet transport speed must be increased to raise the speed of the duplex image formation.

Further, in the apparatus including the duplex feed unit provided with a plurality of switchback paths as disclosed in Japanese Patent Laid-Open No. 2000-143103, when the number of sheets successively transported to the re-feed path exceeds three, the number of sheets transported within the apparatus is suppressed because the interval between the sheets transported to the re-feed path must be held longer than the time required for reversing the sheet. When the number of sheets is two or less, circulative feed for the duplex image formation cannot be performed with high efficiency, and hence the speed of the duplex image formation cannot be increased.

SUMMARY OF THE INVENTION

In view of the state of the art set forth above, it is an object of the present invention to provide an image forming apparatus in which images can be formed on both sides of a sheet at high speed without increasing the apparatus size.

To achieve the above object, the present invention provides an image forming apparatus adapted to reverse a sheet on one side of which an image has been formed in an image forming section, transport the sheet back to the image forming section, and form an image on a second side of the sheet, the apparatus comprising an inlet feed path for transporting a sheet, on one side of which an image has been formed; a switchback path for withdrawing the sheet transported from the inlet feed path; a plurality of reverse feed paths each branching from the switchback path at one of plural positions, each of the plurality of reverse feed paths transporting a sheet while reversing the sheet; and a re-feed path for transporting the reversed sheet from any of the plurality of reverse feed paths back to the image forming section.

Further objects, features and advantages of the present invention will become apparent from the following description of the preferred embodiments with reference to the attached drawings.

BRIEF DESCRIPTION OF THE DRAWINGS

FIGS. 18A, 18B and 18C are a fourth set of schematic views for explaining a flow of sheets in the reverse feed job.

DESCRIPTION OF THE PREFERRED EMBODIMENTS

Embodiments of the present invention will be described below in detail with reference to the drawings.

Figure 1:
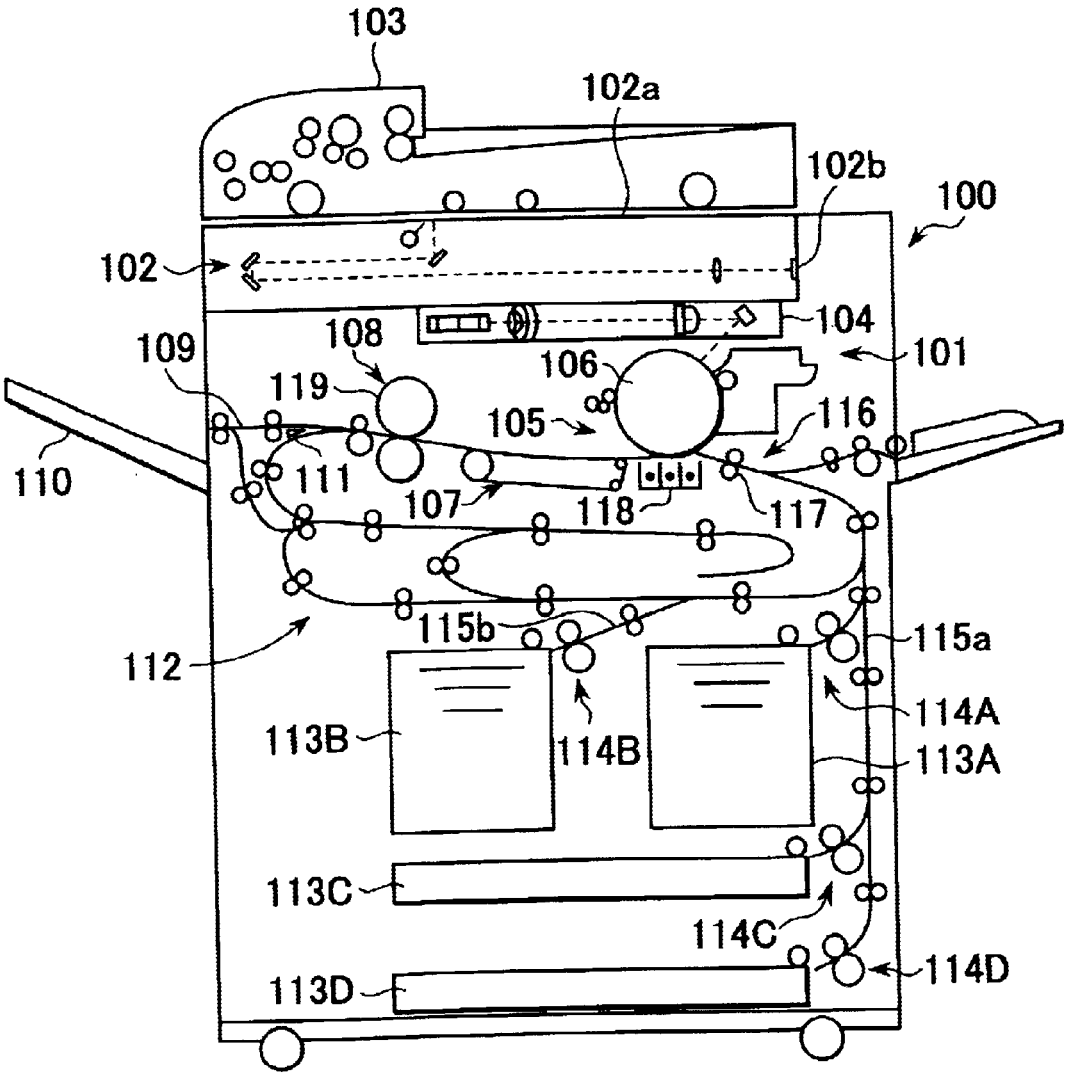
FIG. 1 is a schematic view showing an overall construction of a copying machine as one example of an image forming apparatus according to a first embodiment of the present invention.

FIG. 1 is a schematic view showing an overall construction of a copying machine as one example of an image forming apparatus according to a first embodiment of the present invention.

Referring to FIG. 1, a copying machine 100, to which the present invention is applied, comprises a printer 101 including an image forming section 105 for forming an image on a sheet, and an image reader 102 for reading an image of a document. Also, the copying machine 100 includes an automatic document feeder 103 provided above the image reader 102. The automatic document feeder 103 automatically feeds a document (not shown) onto a platen glass 102*a* of the image reader unit 102. The document is scanned by the image reader unit 102, and digital information from a CCD camera 102*b* is stored as latent image data in a memory (not shown).

Further, in the copying machine 100, a latent image is formed on a photoconductive drum 106 of the image forming section 105 using a scanner 104 in accordance with the stored latent image data. The latent image is then developed with a toner, whereby a toner image is formed on the photoconductive drum 106.

On the other hand, sheet supply cassettes 113A, 113B, 113C and 113D are provided in the printer 101 to serve as sheet containers each containing a number of sheets. Sheets contained in the sheet supply cassettes 113A, 113B, 113C and 113D are supplied one by one respectively by sheet supply units 114A, 114B, 114C and 114D, and are transported to an in-register introducing section 116 at predetermined timing through a feed path 115*a* or feed path 115*b* serving as a part of sheet feed paths.

A register roller pair 117 is provided in the in-register introducing section 116. Skewing of each sheet is corrected by the register roller pair 117, and thereafter the sheet is transported to a transfer/separation charger 118 at predetermined timing. The transfer/separation charger 118 transfers the toner image onto the sheet from the photoconductive drum 106.

Further, a transport section 107 transports the sheet, onto which the toner image has been transferred, to a fusing section 108. The toner image on the sheet transported through the transport section 107 is fused by a fusing roller pair 119 of the fusing section 108. After the toner image has been fused, the sheet is selectively advanced to a sheet ejection tray 110 or a duplex feed unit 112 by a sheet ejection flapper 111 provided in a sheet ejection path 109.

The sheet ejection flapper 111 is controlled by a controller 80 (described later), shown in FIG. 2, such that it is switched over for transport to the side of the sheet ejection tray 110 in the one-sided copying mode in which an image is formed on only one side of a sheet, and to the side of the duplex feed unit 112 in the duplex copying mode in which images are formed on both sides of a sheet.

Figure 2:
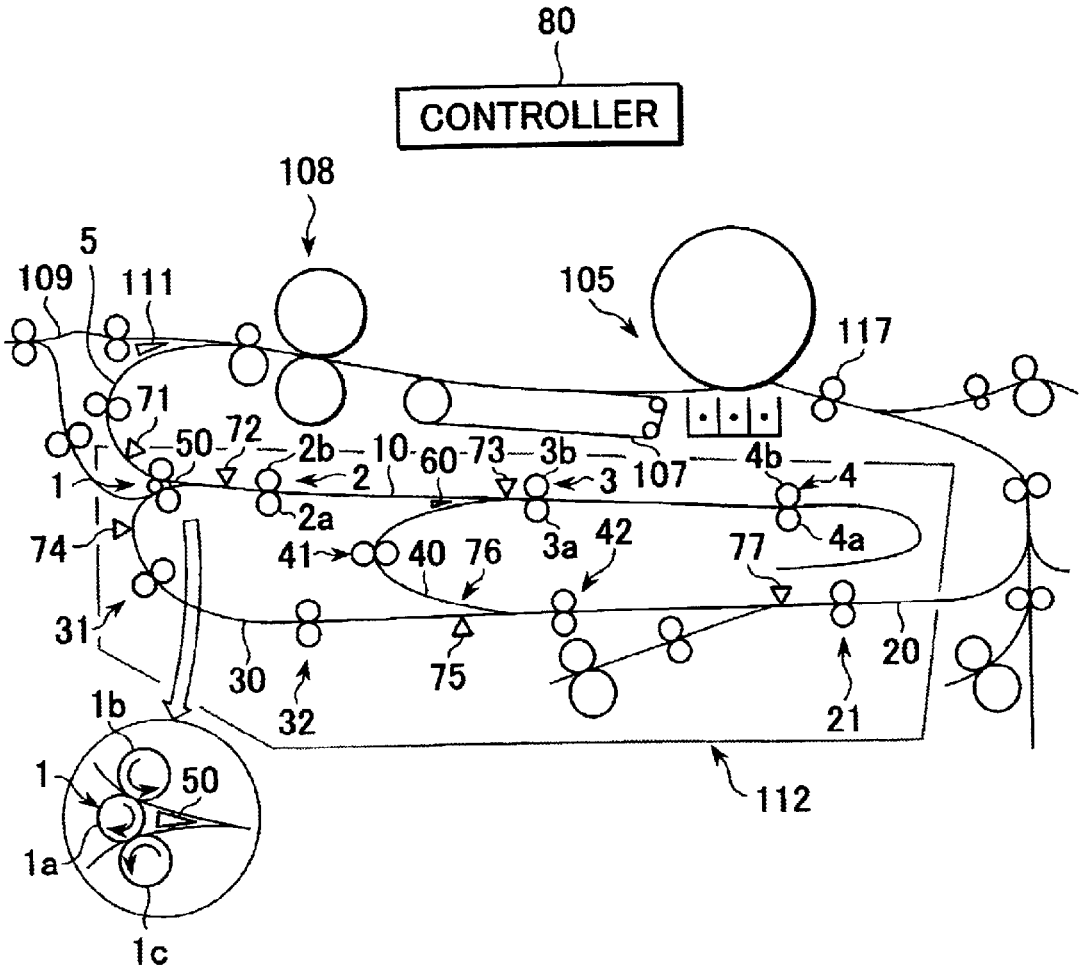
FIG. 2 is an enlarged view showing a duplex feed unit of the copying machine.

FIG. 2 shows a construction of the duplex feed unit 112 for reversing a sheet having an image formed on one side and transporting the reversed sheet again to the image forming section 105 in the duplex copying mode.

As shown in FIG. 2, the duplex feed unit 112 comprises a reverse inlet feed path 5 for guiding the sheet advanced from the sheet ejection flapper 111 into the duplex feed unit 112, a switchback path 10 including a first reversing roller set 1, a second reversing roller pair 2, a third reversing roller pair 3 and a fourth reversing roller pair 4, which serve as sheet feed means, and withdrawing the sheet transported from the reverse inlet feed path 5, and a re-feed path 20 including a re-feed roller pair 21 for transporting the reversed sheet again to the image forming section 105. The duplex feed unit 112 further comprises a first reverse feed path 30 including a first feed roller pair 31 and a second feed roller pair 32, and a second reverse feed path 40 including a third feed roller pair 41 and a fourth feed roller pair 42, those paths 30, 40 being branched from the switchback path 10 and serving to transport the sheet to the re-feed path 20 after reversing it. In addition, the duplex feed unit 112 comprises a first flapper 50 and a second flapper 60 for selectively introducing the sheet from the switchback path 10 to the first reverse feed path 30 and the second reverse feed path 40, respectively.

The switchback path 10 and the re-feed path 20 are linearly extended in a substantially horizontal condition substantially parallel to each other.

A first sensor 71, a second sensor 72 and a third sensor 73 are provided in the switchback path 10, and a seventh sensor 77 is provided in the re-feed path 20. Also, a fourth sensor 74 and a fifth sensor 75 are provided in the first reverse feed path 30, and a sixth sensor 76 is provided in the second reverse feed path 40. In this embodiment, those sensors are each a reflecting photosensor.

The first reversing roller set 1 has a roller arrangement capable of simultaneously giving a transport force for transporting the sheet into the duplex feed unit 112 and a transport force for transporting the sheet from the switchback path 10 into the first reverse feed path 30.

More specifically, the first reversing roller set 1 comprises a drive roller 1*a* and driven rollers 1*b*, 1*c* which are in contact with the drive roller 1*a* and are rotated in directions of respective arrows when the drive roller 1*a* rotates in a directions of arrow. With that arrangement, the transport force for transporting the sheet into the duplex feed unit 112 and the transport force for transporting the sheet from the switchback path 10 into the first reverse feed path 30 can be given simultaneously.

The second reversing roller pair 2, the third reversing roller pair 3 and the fourth reversing roller pair 4 comprise respectively drive rollers 2*a*, 3*a* and 4*a*, driven rollers 2*b*, 3*b* and 4*b* brought into pressure contact with the drive rollers 2*a*, 3*a* and 4*a*, and respective departing mechanisms (not shown) for moving the driven rollers 2*b*, 3*b* and 4*b* apart from the drive rollers 2*a*, 3*a* and 4*a*. By selectively moving the driven rollers 2*b*, 3*b* and 4*b* apart from the drive rollers 2*a*, 3*a* and 4*a* with the departing mechanisms, the transport force is avoided from being transmitted to the sheet.

In FIG. 2, the controller 80 properly controls forward/backward driving of the first reversing roller set 1, the second reversing roller pair 2, the third reversing roller pair 3 and the fourth reversing roller pair 4, switching operations of the sheet ejection flapper 111, the first flapper 50 and the second flapper 60, and driving and stopping of the other feed roller pairs.

A description is now made of the operation of supplying a sheet, on one side of which an image has been formed, again to the image forming section 105 with the duplex feed unit 112 having the above-described construction.

The operation in the case of supplying a reversed sheet again to the image forming section 105 through the first reverse feed path 30 in the duplex feed unit 112 is as follows.

First, when the first sensor 71 detects the fact that a sheet, on one (front) side of which an image has been formed in the image forming section 105 and the fusing section 108, is transported into the duplex feed unit 112 with the aid of the sheet ejection flapper 111 through the reverse inlet feed path 5, the controller 80 rotates, in the forward direction, the first reversing roller set 1 and one or more of the second reversing roller pair 2, the third reversing roller pair 3 and the fourth reversing roller pair 4, which are selected as required to transport the sheet depending on the sheet size in the feed direction. As a result, the sheet is advanced into the switchback path 10.

Then, when the second sensor 72 detects the tailing end of the sheet advanced into the switchback path 10, selectively-driven one(s) or all of the second reversing roller pair 2, the third reversing roller pair 3 and the fourth reversing roller pair 4 are stopped once, and the first flapper 50 is switched over for transport to the first reverse feed path 30 side. Thereafter, the reversing roller pairs having been stopped once are driven to rotate in the backward direction. As a result, the sheet is introduced to the first reverse feed path 30 in the reversed state.

Then, when the fourth sensor 74 detects the leading end of the sheet introduced to the first reverse feed path 30, selectively driven one or both of the second reversing roller pair 2 and the third reversing roller pair 3 are stopped. In addition, the selectively driven rollers of the second reversing roller pair 2 and the third reversing roller pair 3 are moved apart from each other.

By moving the rollers of the reversing roller pair apart from each other, the transport force is not applied to the sheet, thus allowing the next sheet to be advanced into the switchback path 10 while the preceding sheet is introduced to the first reverse feed path 30.

Then, the first feed roller pair 31 and the second feed roller pair 32 are driven successively at respective predetermined timings. As a result, the sheet introduced to the first reverse feed path 30 is transported to the image forming section 105 in the reversed state through the re-feed path 20.

The controller 80 stops the driving of the first feed roller pair 31 and the second feed roller pair 32 at predetermined timing after the sheet has passed the first feed roller pair 31 and the second feed roller pair 32. Also, the controller 80 can make control such that, if it is determined based on a signal from the seventh sensor 77 that the preceding sheet is present on the re-feed path 20 when the fifth sensor 75 detects the leading end of the reversed sheet, the driving of the first feed roller pair 31 and the second feed roller pair 32 is kept stopped, causing the reversed sheet to wait until the preceding sheet passes the re-feed path 20.

The operation in the case of supplying a reversed sheet again to the image forming section 105 through the second reverse feed path 40 in the duplex feed unit 112 is as follows.

First, when the first sensor 71 detects the fact that a sheet, on one (front) side of which an image has been formed and fixed in the image forming section 105 and the fusing section 108, respectively, is transported into the duplex feed unit 112 with the aid of the sheet ejection flapper 111, the first reversing roller set 1, the second reversing roller pair 2, the third reversing roller pair 3 and the fourth reversing roller pair 4 are driven to rotate in the forward direction. As a result, the sheet is advanced into the switchback path 10.

Then, when the third sensor 73 detects the tailing end of the sheet, the third reversing roller pair 3 and the fourth reversing roller pair 4 are stopped once, and the second flapper 60 is switched over for transport to the second reverse feed path 40 side. Thereafter, the third reversing roller pair 3 and the fourth reversing roller pair 4 having been stopped once are driven to rotate in the backward direction, and the first feed roller pair 41 is also driven. As a result, the sheet is introduced to the second reverse feed path 40 in the reversed state.

At this time, the rollers of each of the first reversing roller set 1 and the second reversing roller pair 2 are held in a contacted state so that those rollers can be driven to rotate in the forward direction and can give the transport force for advancing the next sheet which is transported toward the switchback path 10.

Then, when the sixth sensor 76 detects the leading end of the sheet introduced to the second reverse feed path 40, the driving of the third and fourth reversing roller pairs 3, 4 is stopped. In addition, the rollers of the third reversing roller pair 3 are moved apart from each other so that the transport force is not applied to the sheet, thus allowing the next sheet, which is transported toward the switchback path 10, to be advanced into the switchback path 10 while the preceding sheet is introduced to the second reverse feed path 40.

Then, the fourth feed roller pair 42 is started to rotate at a predetermined timing. As a result, the sheet introduced to the second reverse feed path 40 is transported to the image forming section 105 in the reversed state through the re-feed path 20. The controller 80 stops the driving of the third and fourth feed roller pairs 41, 42 at a predetermined timing after the sheet has passed the third and fourth feed roller pairs 41, 42.

Also, the controller 80 can make control such that, if the preceding sheet is present on the re-feed path 20 when the sixth sensor 76 detects the leading end of the reversed sheet, the driving of the third feed roller pair 41 is kept stopped, causing the reversed sheet to wait until the preceding sheet passes the re-feed path 20.

The case of copying six pieces of one-sided documents to both sides of three sheets in the copying machine 100 having the above-described construction will be described below with reference to FIGS. 3 to 5.

First, image data of the six pieces of one-sided documents is stored as latent image data in the memory by the automatic document feeder 103 and the image reader 102, as described above. Subsequently, the respective latent image data stored in the memory and corresponding to the contents of the first, third and fifth pieces of documents are developed in the image forming section 105, transferred onto first to third sheets, and thereafter fused in the fusing section 108.

Then, the first to third sheets having images of the first, third and fifth pieces of documents on their one (front) sides, respectively, are successively transported to the duplex feed unit 112 through the reverse inlet feed path 5 with the aid of the sheet ejection flapper 111 provided in the sheet ejection path 109 while leaving a predetermined interval between the sheets.

In the case of transporting three sheets (P1 to P3) successively in such a way, when the first sensor 71 detects the leading end of the first sheet that has the duplex feed unit 112, the controller 80 first drives the first reversing roller set 1, the second reversing roller pair 2, the third reversing roller pair 3 and the fourth reversing roller pair 4 to rotate in the forward direction, and brings the rollers of each of the second reversing roller pair 2 and the third reversing roller pair 3 into a contacted state so that those roller pairs can give the transport force to the sheet. As a result, the first sheet is advanced into the switchback path 10 with the transport forces applied from the first reversing roller set 1, the second reversing roller pair 2, the third reversing roller pair 3 and the fourth reversing roller pair 4.

Figure 3A:
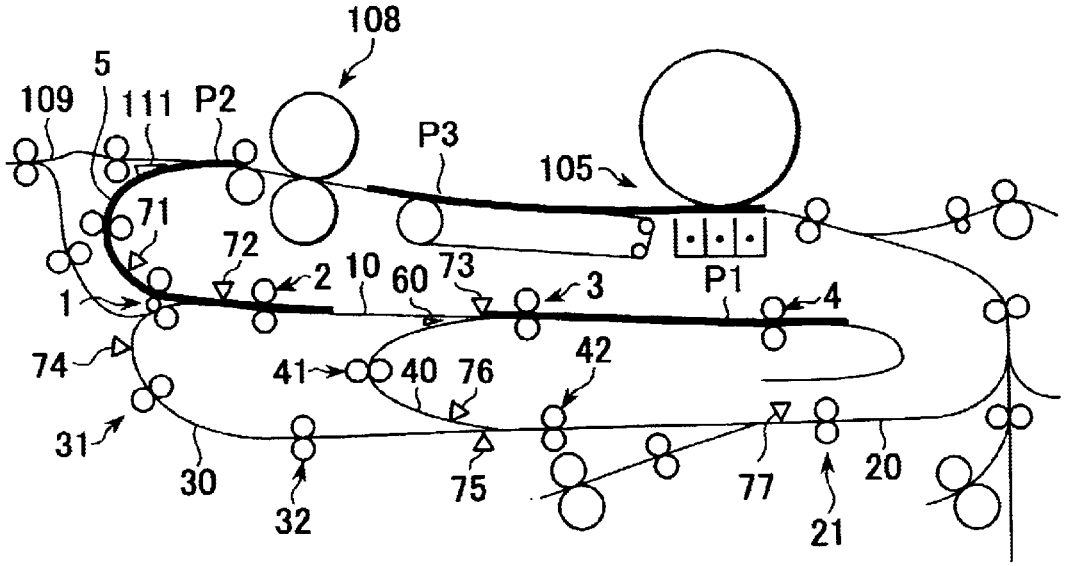
FIGS. 3A and 3B are a first set of schematic views for explaining a flow of sheets when six pieces of one-sided documents are copied on both sides of three sheets in the copying machine.

Then, when the tailing end of the first sheet thus advanced into the switchback path 10 passes the third sensor 73 as shown in FIG. 3A and the third sensor 73 detects the tailing end of the first sheet, the third reversing roller pair 3 and the fourth reversing roller pair 4 are stopped once, and the second flapper 60 is switched over for transport to the second reverse feed path 40 side. Thereafter, the third reversing roller pair 3 and the fourth reversing roller pair 4 having been stopped once are driven to rotate in the backward direction, and the third feed roller pair 41 is also driven.

Figure 3B:
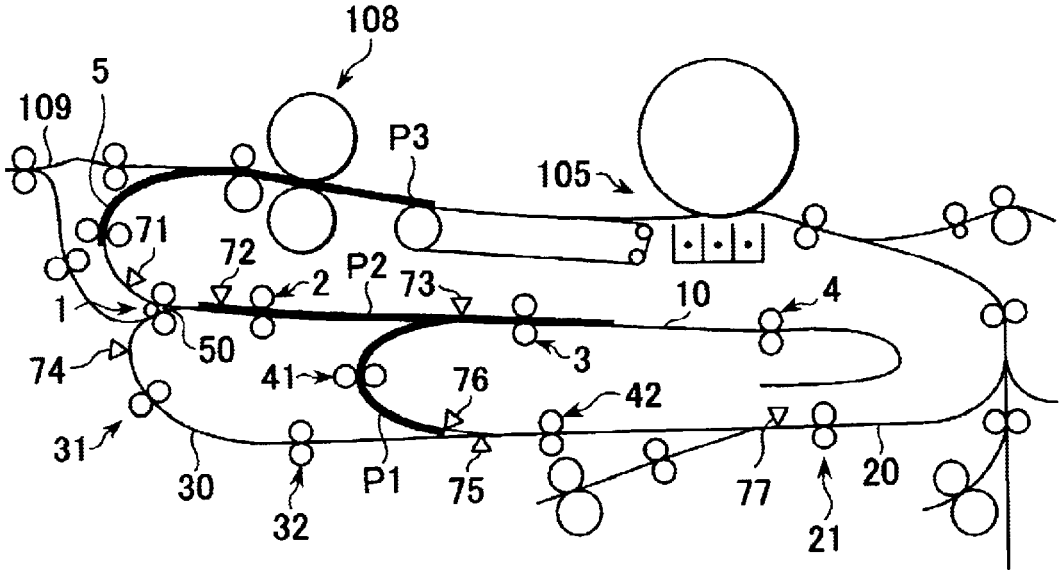

As a result, as shown in FIG. 3B, the first sheet P1 is introduced to the second reverse feed path 40. At this time, not to impede advance of the second sheet P2 transported to the switchback path 10 with a predetermined sheet interval left relative to the first sheet, the driving of the third reversing roller pair 3 is stopped and the rollers thereof are moved apart from each other at a predetermined timing after detection of the tailing end of the first sheet P1 by the third sensor 73.

Then, when the sixth sensor 76 detects the leading end of the first sheet P1 advanced into the second reverse feed path 40, the driving of the fourth reversing roller pair 4 is stopped, and then the driving of the fourth feed roller pair 42 is started after a predetermined time. The first sheet P1 is thereby transported to the re-feed path 20.

In this embodiment, a stepping motor is used as a driving source for each of the feed roller pairs and the reversing roller pairs. To prevent the stepping motor from being out of synchronism, the driving of the fourth feed roller pair 42 is started after a predetermined time from the stop of the driving of the fourth reversing roller pair 4, as described above.

Subsequently, the first sheet P1 is stopped temporarily at a re-supply start position after transporting the first sheet P1 a predetermined distance from a position on the re-feed path 20 at which the leading end of the first sheet has been detected by the seventh sensor 77. While the first sheet P1 is being transported as described above, the second and third sheets P2, P3 are also being transported. Then, when the second sensor 72 detects the tailing end of the second sheet P2 advanced into the switchback path 10 after the second sheet has reached the duplex feed unit 112, the first reversing roller set 1 and the second reversing roller pair 2 are stopped once, and the first flapper 50 is switched over for transport to the first reverse feed path 30 side. Thereafter, the first reversing roller set 1 and the second reversing roller pair 2 having been stopped once are driven to rotate in the backward direction.

Figure 4A:
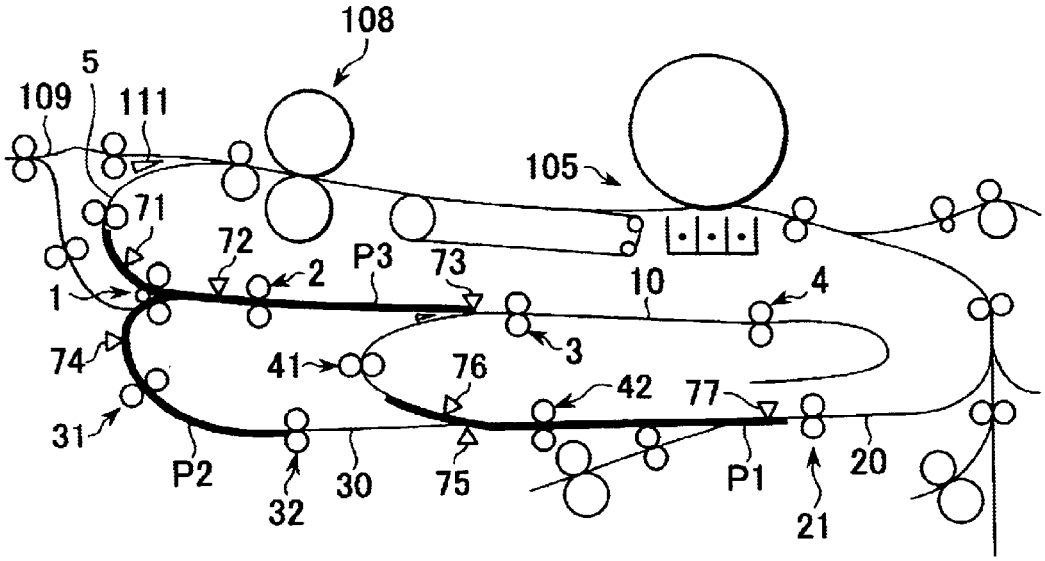
FIGS. 4A and 4B are a second set of schematic views for explaining a flow of sheets when six pieces of one-sided documents are copied on both sides of three sheets in the copying machine.

As a result, as shown in FIG. 4A, the second sheet P2 is introduced to the first reverse feed path 30. At this time, the first sheet P1 is at the re-supply start position. Also, to allow advance of the third sheet P3 transported next to the switchback path 10, the driving of the second reversing roller pair 2 is stopped and the rollers thereof are moved apart from each other when the fourth sensor 74 detects the leading end of the reversed second sheet P2. Incidentally, at the timing at which the tailing end of the second sheet P2 passes the fourth sensor 74, the second reversing roller pair 2 is started to rotate in the forward direction and the rollers thereof are contacted with each other.

Thus, the transport force of the second reversing roller pair 2 is additionally given to the third sheet P3 that has been transported into the switchback path 10 by the first reversing roller set 1 alone until that time. As a result, after the reversed second sheet P2 has passed the first reversing roller set 1, the third sheet P3 is transported by both the first reversing roller set 1 and the second reversing roller pair 2.

Then, when the third sensor 73 detects the leading end of the third sheet P3 having reached the duplex feed unit 112 advanced into the switchback path 10, the third reversing roller pair 3 and the fourth reversing roller pair 4 are driven to rotate in the forward direction, and the third reversing roller pair 3 is brought into contact with the third sheet P3 for transporting it in the switchback path 10. Thereafter, as with the first sheet P1, the roller pairs and the second flapper 60 are controlled so that the third sheet P3 is transported to the second reverse feed path 40 as shown in FIG. 4B.

On the other hand, the first sheet P1 transported to the re-feed path 20 and arrived at the re-supply start position is supplied again to the image forming section 105 after confirming that a sufficient sheet interval is kept relative to the preceding sheet (third sheet P3 in this embodiment).

The second sheet P2 introduced to the first reverse feed path 30 is transported by driving of the first feed roller pair 31 and the second feed roller pair 32. However, if the preceding first sheet P1 is still present in the re-feed path 20 when the fifth sensor 75 detects the leading end of the second sheet P2, the controller 80 makes control such that the driving of the first feed roller pair 31 and the second feed roller pair 32 is stopped once, and transport of the second sheet P2 is resumed while the sheet interval is adjusted causing the second sheet to reach the re-supply start position after the first sheet P1 has passed the feed roller pair 21 in the re-feed path 20.

Figure 4B:
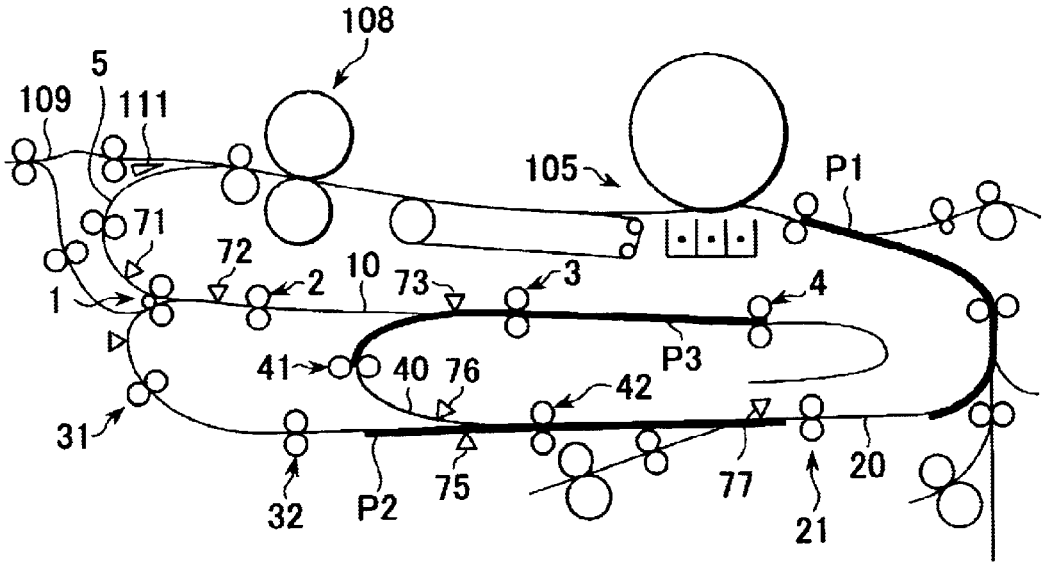

Also, as shown in FIG. 4B, the third sheet P3 introduced to the second reverse feed path 40 is transported by driving of the third feed roller pair 41. However, if the preceding second sheet P2 is still present in the re-feed path 20 when the sixth sensor 76 detects the leading end of the third sheet P3, the controller 80 makes control such that the driving of the third feed roller pair 41 is stopped once, and transport of the third sheet P3 is resumed while the sheet interval is adjusted causing the third sheet to reach the re-supply start position after the second sheet P2 has passed the feed roller pair 21 in the re-feed path 20.

Figure 5A:
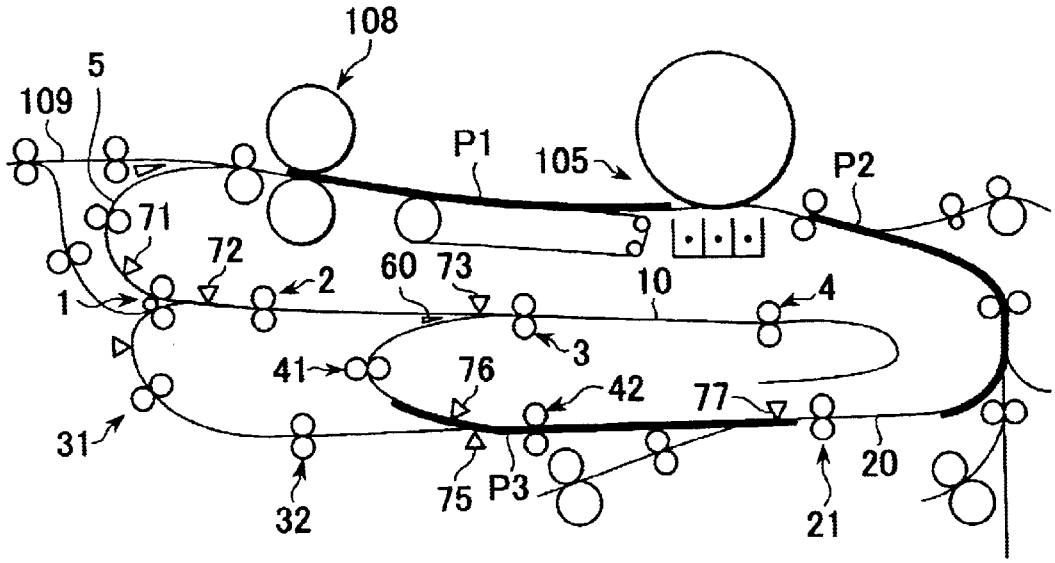
FIGS. 5A and 5B are a third set of schematic views for explaining a flow of sheets when six pieces of one-sided documents are copied on both sides of three sheets in the copying machine.
Figure 5B:
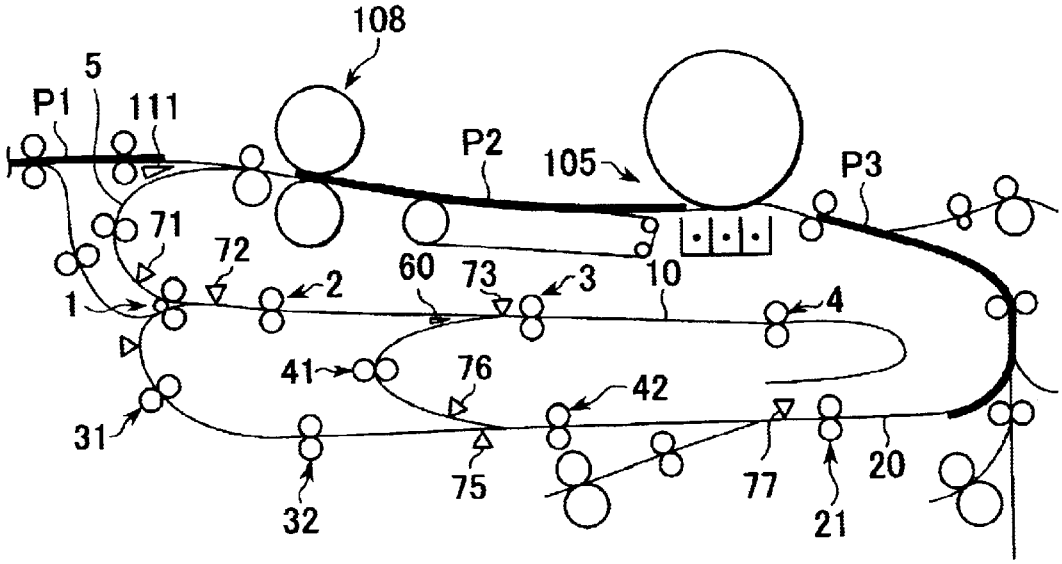

As shown in FIGS. 5A and 5B, the second sheet P2 and the third sheet P3 transported to the re-feed path 20 are supplied again to the image forming section 105 while the sheet interval is adjusted such that each sheet interval relative to the preceding re-supplied first sheet P1 or second sheet P2 is not larger than a predetermined interval at which the respective sheets are transported to the duplex feed unit 112.

Thus, by successively transporting the first to third sheets P1 to P3 to the duplex feed unit 112 at the predetermined interval and selectively introducing the first to third sheets P1 to P3 to the first reverse feed path 30 and the second reverse feed path 40, it is possible to increase the number of places at which the sheet can be temporarily stopped for timing adjustment.

Accordingly, the sheets successively transported into the switchback path 10 at the predetermined interval can be selectively introduced to the first reverse feed path 30 and the second reverse feed path 40, temporarily stopped there, and thereafter sent to the re-feed path 20 in the proper transport order with certainty. Further, the sheets can be re-supplied at the sheet interval adjusted to be not larger than that at which the sheets are transported to the duplex feed unit 112.

As a result, even in an image forming apparatus in which the interval between transported sheets is short or in which the transport speed is high, a number of sheets before being subjected to the image formation can be interposed between the first reversed sheet and the image forming section 105 until the first reversed sheet reaches the image forming section 105. Hence, the duplex image formation can be performed at high speed.

While the above description is made of the operation of copying six pieces of one-sided documents on both sides of three sheets, this embodiment is constructed such that when the number of pieces of documents or the number of copies increases and the number of sheets to be output exceeds, e.g., 5, the sheet interval between the fifth sheet, on the front side of which an image is to be formed, and the first sheet, on the rear side of which an image is to be formed, becomes narrower than a predetermined sheet interval in the image formation process. In such a case, therefore, the duplex copying can be performed at the same sheet interval in the image formation for all of the sheets, and the speed of duplex image formation can be further increased.

Also, while the above description is the case of transporting three sheets within the copying machine at the same time, the present invention is not limited to that case. For example, by changing the number of sheets, which are transported within the copying machine at the same time, depending on the sheet size, it is possible to increase the overall speed of the duplex image formation and to improve productivity.

A second embodiment of the present invention, in which the number of sheets transported within the copying machine at the same time is changed depending on the sheet size, will be described below with reference to FIGS. 6A, 6B and 7.

Figure 6A:
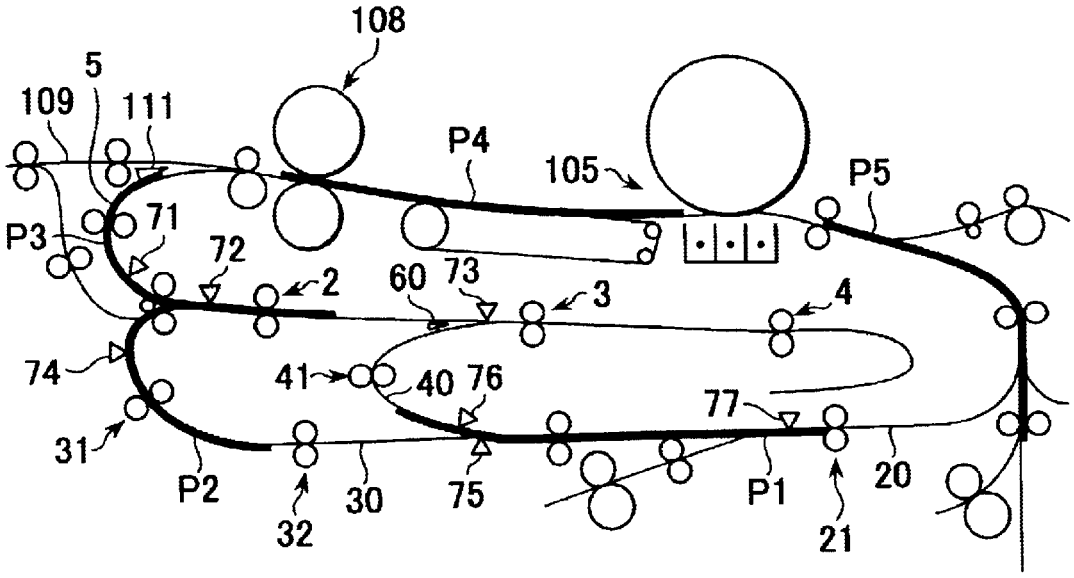
FIGS. 6A and 6B are schematic views showing a flow of sheets when the sheets have a small size and a middle size, respectively, in the feed direction of the duplex feed unit according to a second embodiment of the present invention.
Figure 7:
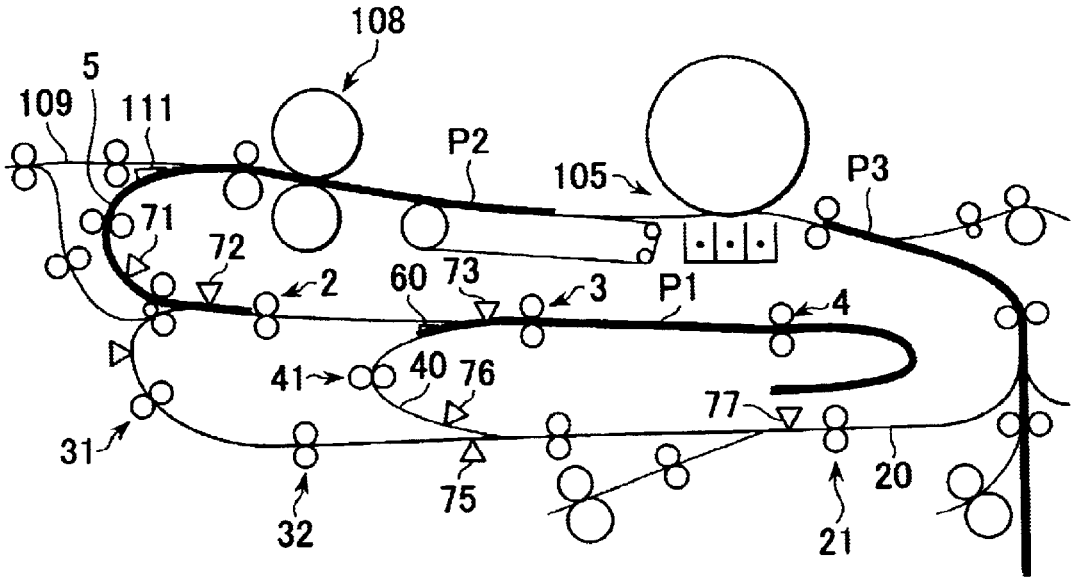
FIG. 7 is a schematic view showing a flow of sheets when the sheets have a large size in the feed direction of the duplex feed unit.

FIG. 6A shows the case of employing small-sized sheets, which are relatively short in the feed direction, in the duplex feed unit according to the second embodiment. It is assumed in this embodiment that the number of sheets transported at the same time is five when the small-sized sheets are employed.

Figure 6B:
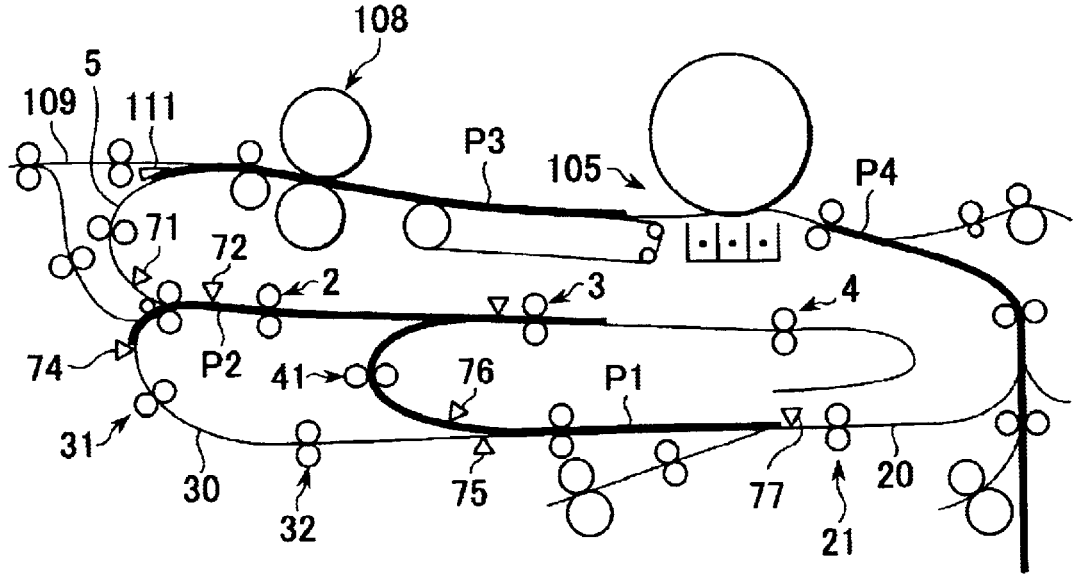

FIG. 6B shows the case of employing mid-sized sheets. When the mid-sized sheets are employed, the number of sheets transported at the same time is four. Also, FIG. 7 shows the case of employing large-sized sheets, which are relatively long in the feed direction. When the large-sized sheets are employed, the number of sheets transported at the same time is three.

The number of transported sheets is determined by calculating, when the forefront (first) sheet P1 reaches the re-supply start position on the re-feed path 20 after passing the second reverse feed path 40 as shown in FIG. 6A, after which number of sheets supplied from the sheet supply cassette 113A, 113B, 113C or 113D the first sheet P1 can be transported, by using predetermined timing at which each sheet is to be transported from the in-register introducing section 116, the predetermined timing being calculated depending on the sheet size in the feed direction.

Additionally, in this embodiment, the sheet size is primarily divided into three ranges. The above-described calculation is performed based on the size within each size range, which gives the shortest predetermined timing at which the sheet is to be transported from the in-register introducing section 116. If the sheet size falls within the same one of the divided size ranges, the controller makes control such that sheets in the same number are transported within the copying machine at the same time.

Thus, by controlling the number of sheets, which are transported within the image forming apparatus at the same time, to be changed depending on the size of sheets transported through the first reverse feed path 30 and the second reverse feed path 40, optimum duplex sheet transport can be always performed regardless of the sheet size. It is therefore possible to increase the overall speed of the duplex image formation and to improve productivity.

In particular, when employing small-sized sheets that are transported at a shorter sheet interval, a larger number of sheets can be transported and more efficient processing can be achieved in the case of forming images on both sides of a large number of sheets.

While the description is made in connection with the copying machine 100 including two reverse feed paths, the speed of the duplex image formation can be further increased.

Figure 8:
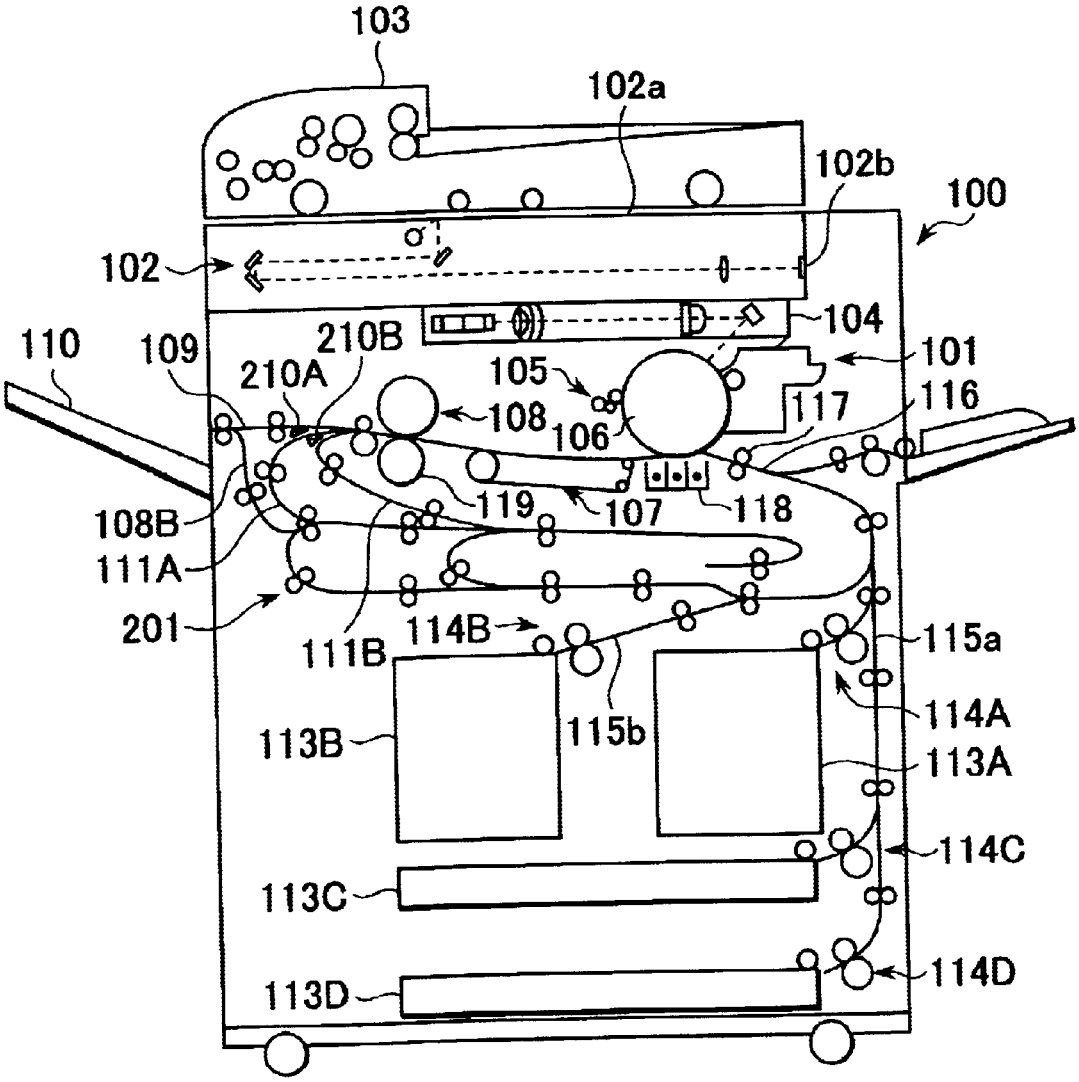
FIG. 8 is a schematic view showing an overall construction of a copying machine as one example of an image forming apparatus according to a third embodiment of the present invention.

A third embodiment of the present invention will be described below with reference to FIGS. 8 to 19. FIG. 8 is a schematic view showing an overall construction of a copying machine as one example of an image forming apparatus according to a third embodiment of the present invention. Note that the same symbols as those in FIG. 1 denote the same components and detailed description of those components is omitted here.

In the third embodiment, a duplex feed unit 201 is provided instead of the duplex feed unit 112 in the first embodiment. A toner image is transferred to a sheet in an image forming section 105 of a printer 101, and the toner image is fused by a fusing roller pair 119 of a fusing section 118. The sheet having the toner image thus fused is selectively advanced with the aid of first and second sheet ejection flappers 210A, 210B provided in a first sheet ejection path 109 to a sheet ejection tray 109, a first reverse inlet feed path 211A or a second reverse inlet feed path 211B. Then, the sheet enters the duplex feed unit 201 through the first reverse inlet feed path 211A or the second reverse inlet feed path 211B.

The sheet ejection flappers 210A, 210B are each controlled by a controller 80 (described later), shown in FIG. 9, such that it is switched over to the side of the sheet ejection tray 110 in the one-sided copying mode in which an image is formed on only one side of a sheet P, and to the side of the duplex feed unit 201 in the duplex copying mode in which images are formed on both sides of a sheet or the multiple copying mode in which images are formed on one side of a sheet plural times.

Figure 9:
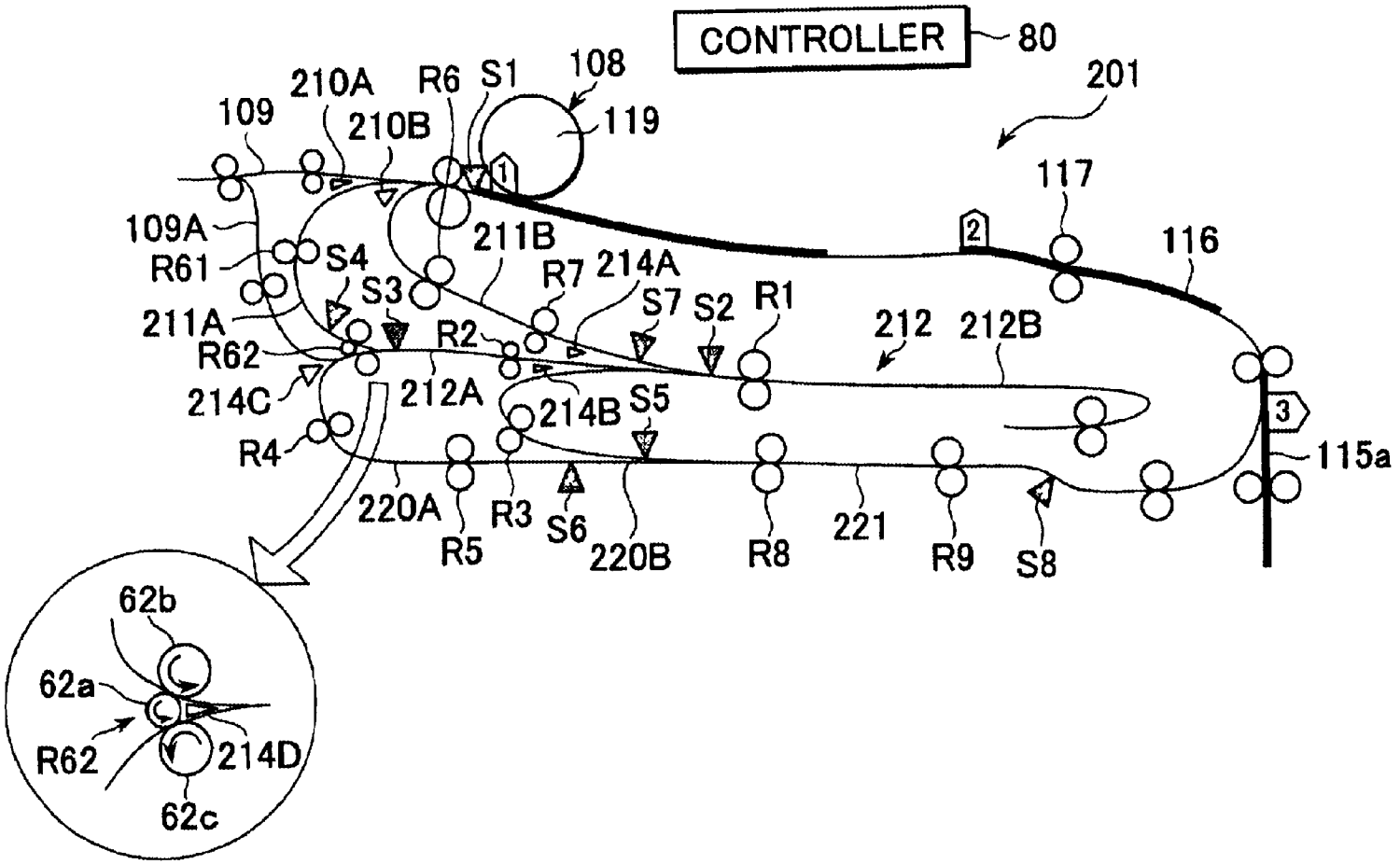
FIG. 9 is an enlarged view showing a duplex feed unit of the copying machine.

FIG. 9 shows a construction of the duplex feed unit 201 for reversing a sheet having an image formed on one side and transporting the reversed sheet again to the image forming section 105 in the duplex copying mode.

As shown in FIG. 9, the duplex feed unit 201 comprises the first reverse inlet feed path 211A including a roller pair R61 and a roller set R62, the second reverse inlet feed path 211B including roller pairs R6, R7, and a re-feed path 221 including re-feed roller pairs R8, R9 for transporting the reversed sheet again to the image forming section 105.

Also, the duplex feed unit 201 comprises a switchback path 212 for withdrawing the sheet transported from the first reverse inlet feed path 211A and the second reverse inlet feed path 211B. The first reverse inlet feed path 211A and the second reverse inlet feed path 211B merge into the switchback path 212, and the switchback path 212 has a first switchback path 212A including a roller pair R2, and a second switchback path 212B including a roller pair R1. Further, the duplex feed unit 201 comprises a first reverse feed path 220A including roller pairs R4, R5, and a second reverse feed path 220B including a roller pair R3, those paths 220A, 220B being branched from the switchback path 212 and serving to transport the sheet to the re-feed path 221.

In addition, the duplex feed unit 201 comprises a first flapper 214A and a second flapper 214B for selectively introducing the sheet from the second switchback path 212B to the second reverse feed path 220B, and a third flapper 214C and a fourth flapper 214D for selectively introducing the sheet from the first switchback path 212A to the first reverse feed path 220A or a second page ejection path 109A.

The switchback path 212 and the re-feed path 221 are linearly extended in a substantially horizontal condition substantially parallel to each other.

A fourth sensor S4 is provided in the first reverse inlet feed path 211A, and a seventh sensor S7 is provided in the second reverse inlet feed path 211B. An eighth sensor S8 is provided in the re-feed path 221, a sixth sensor S6 is provided in the first reverse feed path 220A, and a fifth sensor S5 is provided in the second reverse feed path 220B. A third sensor S3 is provided in the first switchback path 212A, and a second sensor S2 is provided in the second switchback path 212B. In this embodiment, those sensors are each a reflecting photosensor.

The roller set R62 has a roller arrangement capable of simultaneously giving a transport force for transporting the sheet from the first reverse inlet feed path 211A into the first switchback path 212A and a transport force for transporting the sheet from the first switchback path 212A into the first reverse feed path 220A.

More specifically, the roller set R62 comprises a drive roller 62*a* and driven rollers 62*b*, 62*c* which are in contact with the drive roller 62*a* and are rotated in directions of respective arrows when the drive roller 62*a* rotates in a direction of arrow. With that arrangement, the transport force for transporting the sheet from the first reverse inlet feed path 211A into the first switchback path 212A and the transport force for transporting the sheet from the first switchback path 212A into the first reverse feed path 220A can be given simultaneously.

In FIG. 9, the controller 80 properly controls forward/backward driving of the roller pairs R1 to R9 and R61 and the roller set R62, as well as pivotal movement of the sheet ejection flappers 210A, 210B and the first to fourth flappers 214A to 214D. Incidentally, S1 denotes a first sensor for detecting the fact that the sheet has passed the fusing roller pair 119.

A description is now made of the operation of supplying a sheet, on one side of which an image has been formed, again to the image forming section 105 with the duplex feed unit 201 having the above-described construction under control of the controller 80.

The duplex feed operation for reversing a sheet, e.g., a short-sized sheet, on one side of which an image has been formed, and then transporting the reversed sheet again to the image forming section 105 is as follows.

In the duplex feed operation, sheets are transported at predetermined intervals between them as shown in FIG. 9. First, when the first sensor S1 detects the fact that a first sheet No. 1 having an image formed on one side and positioned at the head has passed the fusing roller pair 119, the controller 80 switches over the first and second sheet ejection flappers 210A, 210B for selectively introducing subsequent sheets to the first and second reverse inlet feed paths 211A, 211B.

In this embodiment, the first sheet ejection flapper 210A and the second sheet ejection flapper 210B are controlled such that (2n+1)-th (n is an integer equal to or larger than 0) sheets are introduced to the second reverse inlet feed path 211B, and (2n+2)-th sheets are introduced to the first reverse inlet feed path 211A.

Figure 10A:
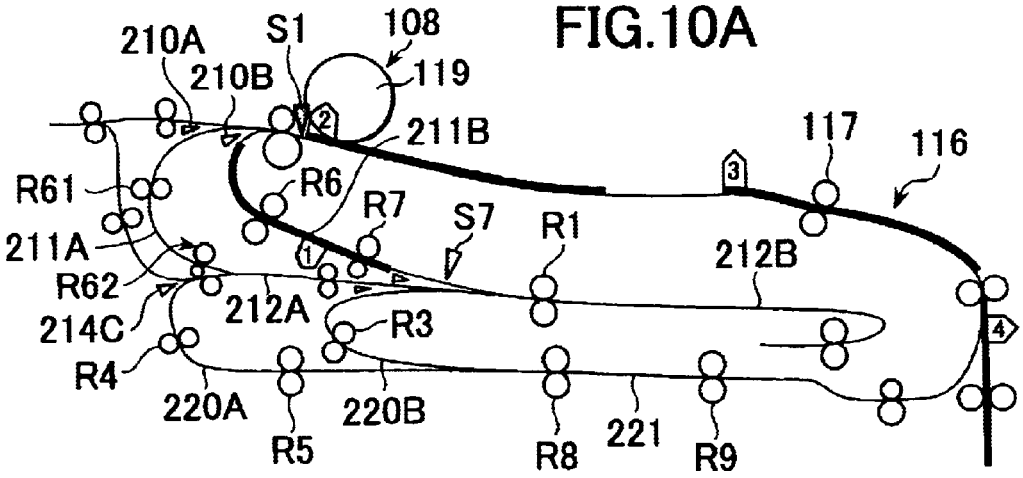
FIGS. 10A, 10B and 10C are a first set of schematic views for explaining a flow of sheets when the sheets are supplied again to an image forming section using the duplex feed unit.

As a result, as shown in FIG. 10A, the first sheet No. 1 is introduced to the second reverse inlet feed path 211B. Then, when the seventh sensor S7 detects the leading end of the first sheet No. 1, the controller 80 checks whether the preceding sheet is present in the second switchback path 212B at a downstream position. Here, since there is no preceding sheet, the first sheet No. 1 is continuously transported toward the second switchback path 212B.

After the above-mentioned transport of the first sheet No. 1 toward the second switchback path 212B, when the first sensor S1 detects that a succeeding second sheet No. 2 has passed the fusing roller pair 119, the controller 80 switches over the first and second sheet ejection flappers 210A, 210B for introducing the second sheet No. 2 to the first reverse inlet feed path 211A. Thereafter, a third sheet No. 3 and a fourth sheet No. 4 are also similarly transported.

Figure 10B:
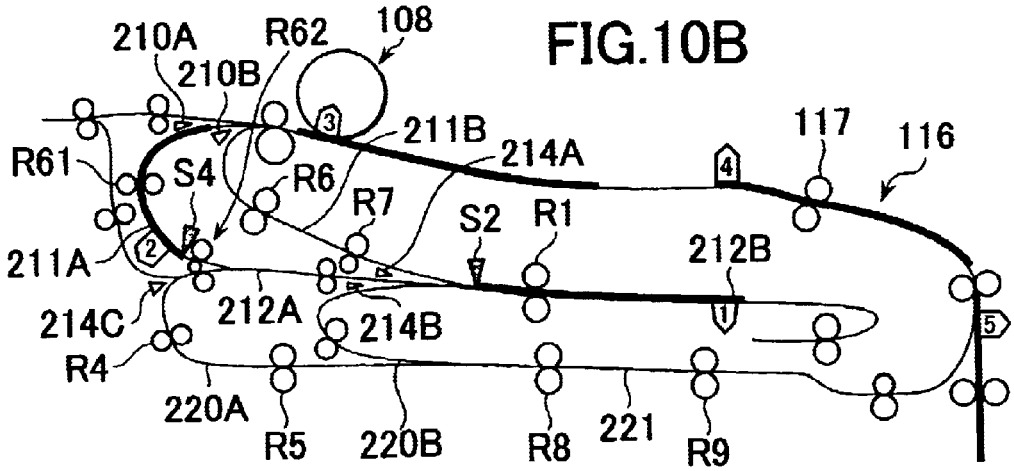

Then, as shown in FIG. 10B, when the first sheet No. 1 is advanced into the second switchback path 212B and the second sensor S2 in the second switchback path 212B detects the passage of the first sheet No. 1, driving of the roller pair R1 to rotate in the forward (feed) direction is stopped to cease further transport of the first sheet No. 1. In this embodiment, a stepping motor is used as a driving source for each of the roller pairs. To prevent the stepping motor from being out of synchronism, the roller pair is stopped for a predetermined time until specific vibrations of the motor is stabilized.

After lapse of the predetermined time, the roller pair R1 is driven to rotate in the backward direction to transport the first sheet No. 1. Thereafter, when the second sensor S2 detects again the first sheet No. 1, the controller controls the first flapper 214A and the second flapper 214B so that the first sheet No. 1 is introduced to the second reverse feed path 220B.

On the other hand, when the fourth sensor S4 detects the leading end of the second sheet No. 2 transported to the first reverse inlet feed path 211A, the controller 80 checks whether the preceding sheet is present at a downstream position where the first switchback path 212A is provided. Here, since there is no preceding sheet, the second sheet No. 2 is continuously transported toward the first switchback path 212A.

Figure 10C:
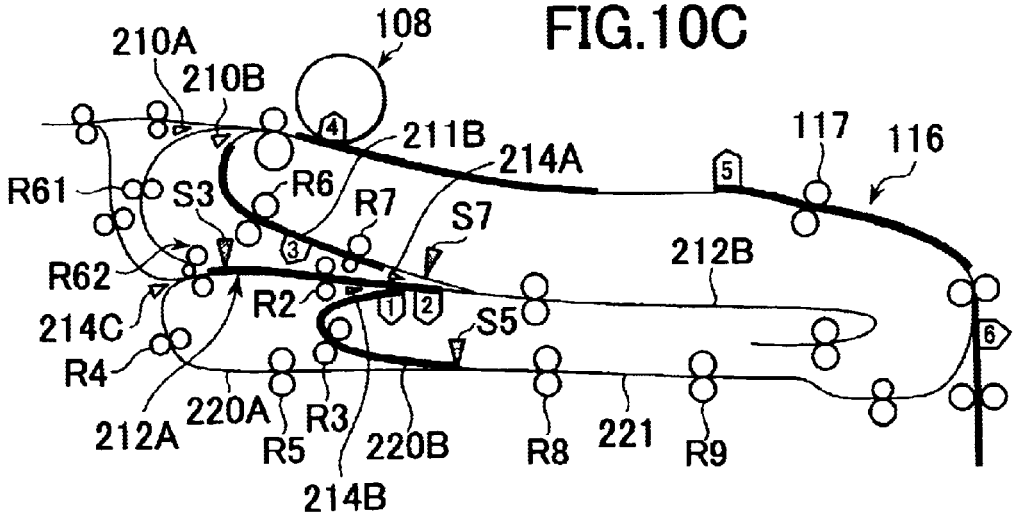

Accordingly, as shown in FIG. 10C, the first sheet No. 1 is introduced to the second reverse feed path 220B and the second sheet No. 2 is advanced into the first switchback path 212A. Thereafter, when the fifth sensor S5 detects the first sheet No. 1, the roller pair R3 is stopped to cease the transport of the first sheet No. 1 temporarily. Then, at proper timing of re-supplying the first sheet No. 1 from the re-feed path 221 subsequent to a seventh sheet (not shown) which is supplied from one of the sheet supply cassettes 113A, 113B, 113C and 113D (see FIG. 8) subsequent to a sixth sheet No. 6, the driving of the roller pair R3 is started again to resume the transport of the first sheet No. 1.

Also, when the third sensor S3 detects the passage of the second sheet No. 2, the roller pair R2 is stopped and then it is driven to rotate backwardly to transport the second sheet No. 2 in the backward direction. Thereafter, when the third sensor S3 detects again the passage of the second sheet No. 2, the controller controls the third flapper 214C and the fourth flapper 214D so that the second sheet No. 2 is introduced to the first reverse feed path 220A.

In parallel to the above-described feed operation of the first sheet No. 1 and the second sheet No. 2, the controller controls the sheet ejection flappers 210A, 210B so as to introduce a third sheet No. 3, as next one of the (2n+1)-th sheets, to the second reverse inlet feed path 211B. Then, when the seventh sensor S7 detects the leading end of the third sheet No. 3 transported through the second reverse inlet feed path 211B, the controller checks whether the preceding sheet is present in the second switchback path 212B. Here, since there is no preceding sheet, the third sheet No. 3 is continuously transported toward the second switchback path 212B. Other sheets subsequent to the third sheet are also controlled in a similar manner.

Figure 11A:
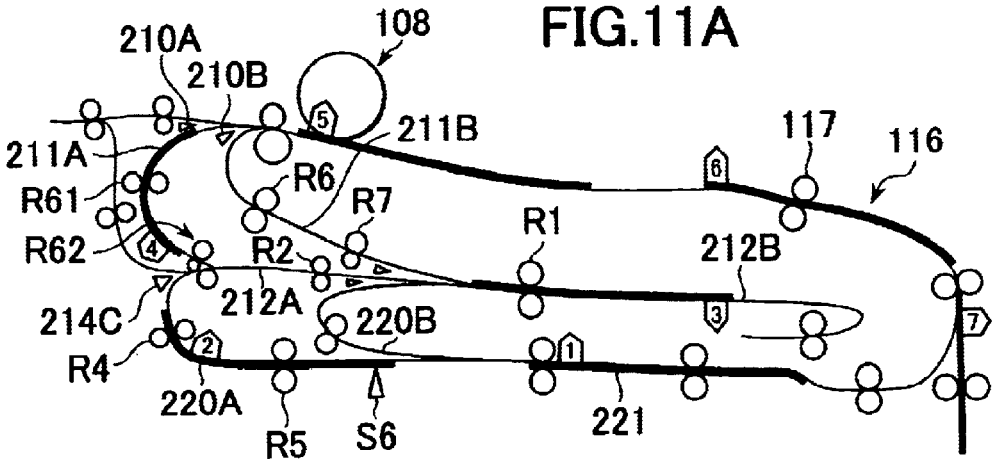
FIGS. 11A, 11B and 11C are a second set of schematic views for explaining a flow of sheets when the sheets are supplied again to an image forming section using the duplex feed unit.

Then, as shown in FIG. 11A, the first sheet No. 1 having resumed movement is transported to the re-feed path 221. As mentioned above, the first sheet No. 1 is resupplied from the re-feed path 221 at the timing of transporting it subsequent to the seventh sheet No. 7. In this embodiment, the number of sheets capable of standing by in the first reverse inlet feed path 211A, the second reverse inlet feed path 211B, the first switchback path 212A, the second switchback path 212B, the first reverse feed path 220A, the second reverse feed path 220B, and the re-feed path 221 is five. Accordingly, as shown in FIG. 11C described below, the first sheet No. 1 is transported to the feed path 115*a* at the time when the sixth sheet No. 6 is introduced to the first reverse inlet feed path 211A.

When transporting the first sheet No. 1 to the feed path 115*a* as described above, however, the interval between the first sheet No. 1 and the sixth sheet No. 6 becomes to large. In this embodiment, therefore, the seventh sheet No. 7 is transported subsequent to the sixth sheet No. 6, and thereafter the first sheet No. 1 is transported. With such a sequence, the sheets can be transported at a predetermined sheet interval without accelerating the motor. Subsequently, the sheets are likewise transported such that the second sheet No. 2 follows an eight sheet, the third sheet No. 3 follows a ninth sheet, and so on.

On the other hand, when the sixth sensor S6 detects the second sheet No. 2 in the first reverse feed path 220A, the driving of the roller pairs R4, R5 is stopped temporarily. Then, at proper timing of re-supplying the second sheet No. 2 subsequent to the eighth sheet (not shown) that is supplied subsequent to the first sheet No. 1 re-supplied from the re-feed path 221, the driving of the roller pairs R4, R5 is started again to resume the transport of the second sheet No. 2. The other subsequent sheets are also controlled in a similar manner.

Figure 11B:
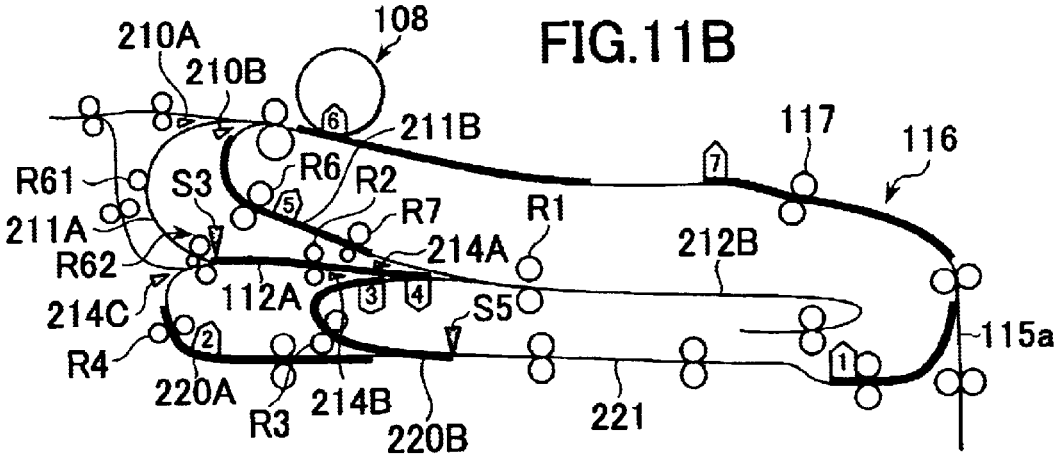
Figure 11C:
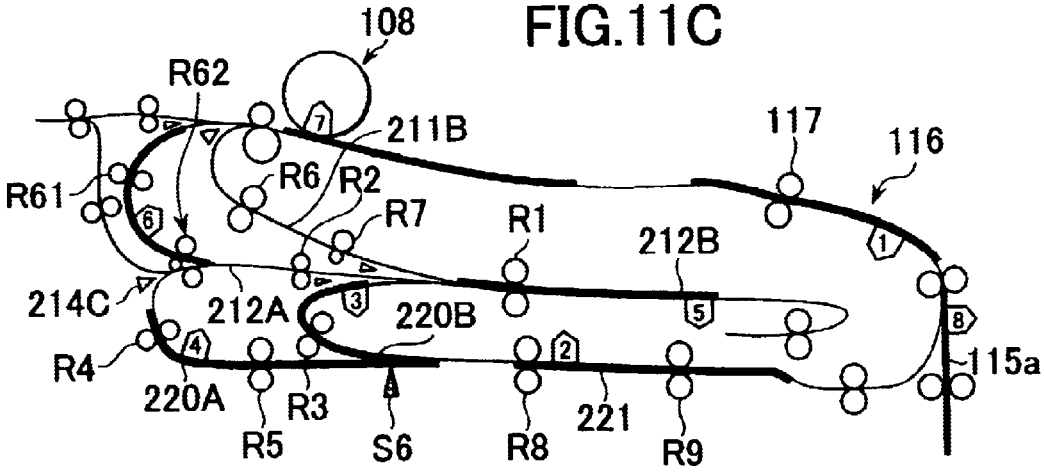

Then, as shown in FIG. 11B, the first sheet No. 1 is transported to the feed path 115*a* after the seventh sheet No. 7 which is supplied from one of the sheet supply cassettes 113A, 113B, 113C and 113D. Note that, in FIG. 11B, the seventh sheet No. 7 is supplied from one of the sheet supply cassettes 113A, 113C and 113D.

At this time, the eighth sheet No. 8 is not yet transported to the feed path 115*a*, and therefore the second sheet No. 2 is kept at a standstill. For the third sheet No. 3, the controller controls the first flapper 214A and the second flapper 214B so that the third sheet No. 3 is introduced to the second reverse feed path 220B from the second switchback path 212B. On that occasion, when the fifth sensor S5 detects the leading end of the third sheet No. 3, the driving of the roller pair R3 is also stopped temporarily, causing the third sheet No. 3 to stand by, because the preceding second sheet No. 2 is still standing by in the first reverse feed path 220A.

Further, the fourth sheet No. 4 is transported through the first reverse inlet feed path 211A and reaches the first switchback path 212A. On that occasion, when the third sensor S3 detects the tailing end of the fourth sheet No. 4, the controller controls the third flapper 214C and the fourth flapper 214D so that the fourth sheet No. 4 is introduced to the first reverse feed path 220A. At this time, however, since the preceding second sheet No. 2 is still standing by in the first reverse feed path 220A, the driving of the roller pair R2 is stopped temporarily, causing the fourth sheet No. 4 to stand by in the first switchback path 212A. Other subsequent sheets are also controlled in a similar manner.

Subsequently, as shown in FIG. 11C, at the time when the first sheet No. 1 has passed the register roller pair 117 in the in-register introducing section 116 and the subsequent eighth sheet No. 8 is transported to the feed path 115*a*, the second sheet No. 2 is already transported from the first reverse feed path 220A to the re-feed path 221 at the timing of re-supplying the second sheet No. 2 to the feed path 115*a* subsequent to the eighth sheet No. 8 as mentioned above.

In parallel, the fourth sheet No. 4 is transported to the first reverse feed path 220A and the sixth sensor S6 detects the leading end of the fourth sheet No. 4. At this time, however, since the preceding third sheet No. 3 is still standing by in the second reverse feed path 220B, the driving of the roller pairs R4, R5 is stopped to cease the transport of the fourth sheet No. 4 temporarily. Also, the fifth sheet No. 5 is controlled so as to stand by in the second switchback path 212B because the second reverse feed path 220B on the downstream side is occupied by the third sheet No. 3. Other subsequent sheets are also controlled in a similar manner.

Figure 12A:
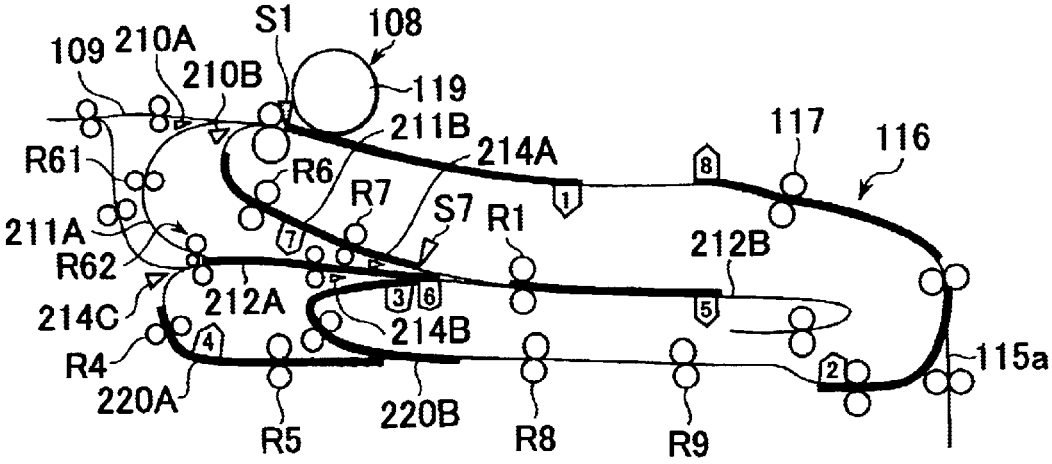
FIGS. 12A and 12B are a third set of schematic views for explaining a flow of sheets when the sheets are supplied again to an image forming section using the duplex feed unit.

Then, as shown in FIG. 12A, when the leading end of the first sheet No. 1 reaches the first sensor S1 after having passed the fusing roller pair 119 and it is detected by the first sensor S1, the controller controls the first and second sheet ejection flappers 210A, 210B so as to transport the first sheet No. 1 to the first sheet ejection path 109.

On the other hand, the second sheet No. 2 is transported to the feed path 115*a* subsequent to the eighth sheet No. 8 which is supplied from one of the sheet supply cassettes 113A, 113B, 113C and 113D. The third sheet No. 3 is still at a standstill, and the fourth sheet No. 4 is kept in the standby state because the third sheet No. 3 is standing by in the second reverse feed path 220B. Further, the fifth and sixth sheets Nos. 5 and 6 are also kept in the standby state because the respective preceding sheets remain in the downstream side.

At this time, the seventh sheet No. 7 is already introduced to the second reverse inlet feed path 211B. When the seventh sensor S7 detects the leading end of the seventh sheet No. 7, the driving of the roller pairs R6, R7 is stopped to cease the transport of the seventh sheet No. 7 temporarily if the preceding sheet is present in the second switchback path 212B or if the roller pair R1 is rotated in the direction opposite to the feed direction of the seventh sheet No. 7. Other subsequent sheets are also controlled in a similar manner.

Figure 12B:
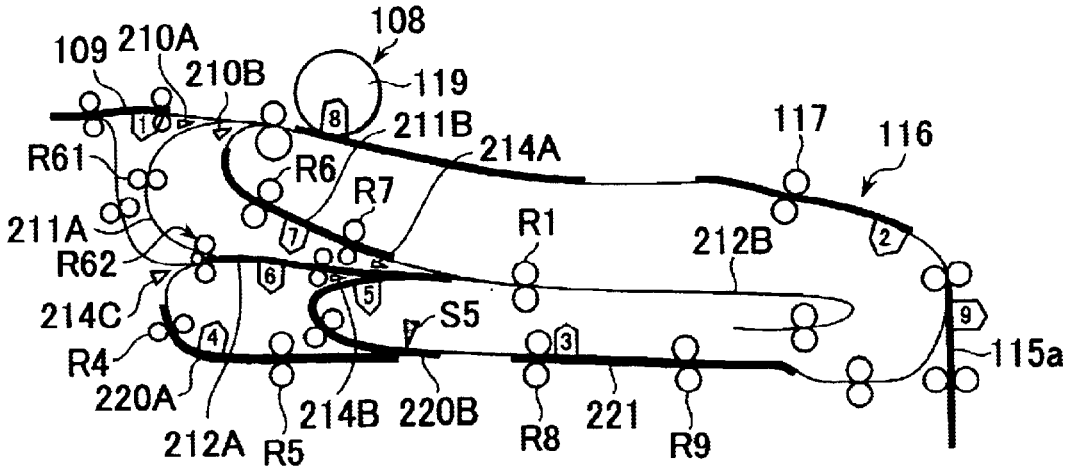

Then, as shown in FIG. 12B, the first sheet No. 1 is transported to the first sheet ejection path 109 and ejected out of the machine. The second sheet No. 2 is transported in a similar manner as with the first sheet No. 1, and the third sheet No. 3 is transported from the second reverse feed path 220B to the re-feed path 221 at the timing of re-supplying it to the feed path 115*a* subsequent to a ninth sheet No. 9.

Correspondingly, the fifth sheet No. 5 is advanced to the second reverse feed path 220B and the fifth sensor S5 detects the leading end of the fifth sheet No. 5. At this time, however, since the preceding fourth sheet No. 4 is still standing by in the first reverse feed path 220A, the driving of the roller pair R3 is stopped to cease the transport of the fifth sheet No. 5 temporarily. Other subsequent sheets are also controlled in a similar manner.

Figure 13A:
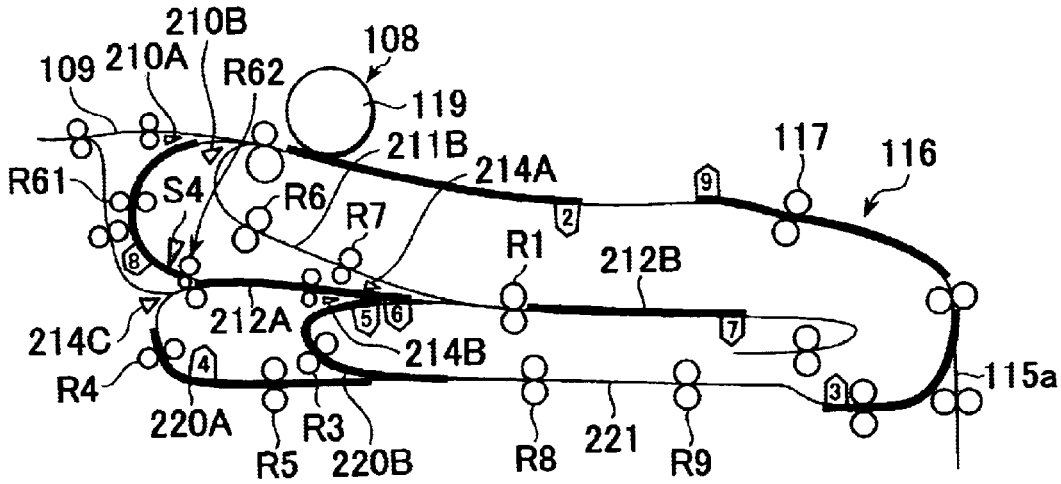
FIGS. 13A and 13B are a fourth set of schematic views for explaining a flow of sheets when the sheets are supplied again to an image forming section using the duplex feed unit.

Then, as shown in FIG. 13A, the leading end of the second sheet No. 2 passes the fusing roller pair 119. When the first sensor S1 detects the leading end of the second sheet No. 2, the controller controls the first and second sheet ejection flappers 210A, 210B so as to transport the second sheet No. 2 to the first sheet ejection path 109. Also, the third sheet No. 3 is transported to the feed path 115*a* subsequent to the ninth sheet No. 9 which is supplied from one of the sheet supply cassettes 113A, 113B, 113C and 113D.

Further, when the fourth sensor S4 detects the eighth sheet No. 8, the driving of the roller pair R6 is stopped to cease the transport of the eighth sheet No. 8 temporarily because it is known that the sixth sheet No. 6 is still present in the first switchback path 212A on the downstream side. Other subsequent sheets are also controlled in a similar manner.

Figure 13B:
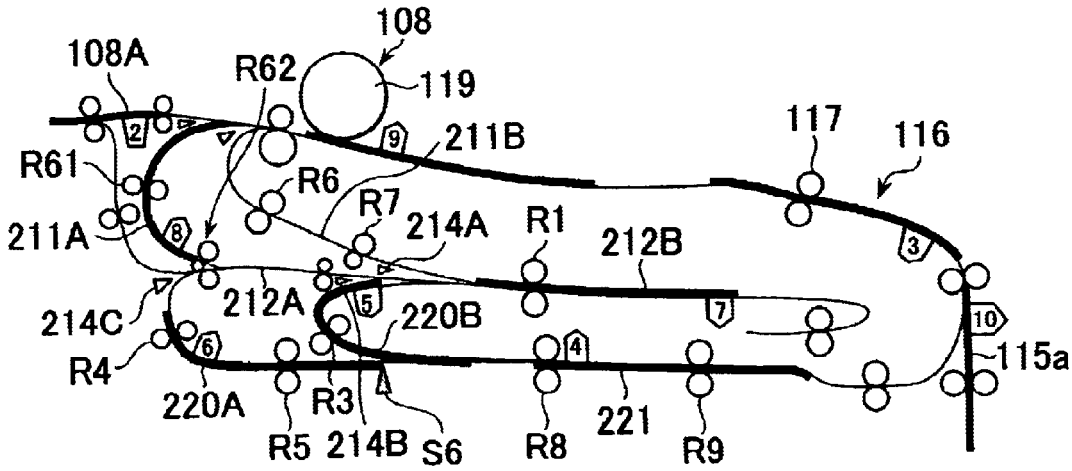

Then, as shown in FIG. 13B, the second sheet No. 2 is transported to the first sheet ejection path 109 and ejected out of the machine. The third sheet No. 3 is transported in a similar manner as with the second sheet No. 2, and the fourth sheet No. 4 is transported to the re-feed path 221 at the timing of re-supplying it to the feed path 115*a* subsequent to a tenth sheet No. 10. In the state shown in FIG. 13B, the fourth sheet No. 4 is already transported from the first reverse feed path 220A to the re-feed path 221.

Simultaneously, the sixth sheet No. 6 is advanced to the first reverse feed path 220A and the sixth sensor S6 detects the leading end of the sixth sheet No. 6. At this time, however, since the preceding fifth sheet No. 5 is still standing by in the second reverse feed path 220B, the driving of the roller pair R5 is stopped to cease the transport of the sixth sheet No. 6 temporarily. Other subsequent sheets are also controlled in a similar manner. The sequence of sheet duplex feed after this point is executed by repeating the steps shown in FIGS. 9 to 13.

Thus, by providing the two first and second reverse inlet feed paths 211A, 211B and the two first and second reverse feed paths 220A, 220B with respect to the switchback path 212 (first and second switchback paths 212A, 212B), maximum six points at which sheets are able to stand by, can be ensured in the case of transporting short-sized sheets.

Then, by ensuring those maximum six standby points, the sheets successively introduced to the first reverse inlet feed path 211A and the second reverse inlet feed path 211B can be kept stand by in the first reverse inlet feed path 211A, the second reverse inlet feed path 211B, the first reverse feed path 220A, the second reverse feed path 220B, and the re-feed path 221 in the predetermined sequence.

Further, by causing the sheets to stand by in the predetermined sequence as described above, the sheets can be successively re-supplied from one standing by in the re-feed path 221 in the same order as that, in which the sheets are transported to the in-register introducing section 116, at predetermined timing, i.e., the timing at which the interval between the sheets successively introduced to the first reverse inlet feed path 211A and the second reverse inlet feed path 211B becomes equal to the interval between the sheets transported to the in-register introducing section 116. Hence, images can be formed on both sides of sheets at high speed.

Moreover, maximum 13 sheets can be transported within the copying machine in a circulative manner without accelerating the motor by circulating the sheets, as described above, such that the reversed first sheet No. 1 is transported subsequent to the seventh sheet No. 7, the reversed second sheet No. 2 is transported subsequent to the eighth sheet No. 8, and after transporting the subsequent sheets similarly, the reversed seventh sheet No. 7 is transported to the in-register introducing section 116 (feed path 115*a*).

As a result, the body size of the copying machine capable of forming images on both sides of sheets at high speed can be reduced, and the driving of its a motor can be controlled with a sufficient allowance because there is no need to accelerate the motor. Also, since the reversing process can be distributed, it is possible to reduce the frequency in driving of the motor and to prolong the life of parts. Further, since the sheets can be transported to the in-register introducing section 116 in a circulative manner at a predetermined interval from the first to last sheet, sheet duplex feed can be realized with 100% performance.

While the above description is made in connection with a copying machine including two reverse inlet feed paths, two switchback paths and two reverse feed paths, the present invention is not limited that construction. For example, the reverse inlet feed paths, the switchback paths and the reverse feed paths may be provided three or more.

When one-sided documents are mixed in with two-sided documents, it has been conventional that the one-sided document is regarded the same as the two-sided document, and process control is similarly executed regardless of the one side being blank. According to the present invention, when one-sided documents are mixed in with two-sided documents, sheets corresponding to one-sided documents are not supplied again to the image forming section 105 and are ejected immediately after being reversed even in the sheet duplex feed mode.

By executing such a reverse feed job of ejecting a sheet just after reversing it even in the sheet duplex feed mode, power consumption can be reduced and an additional expense is avoided. Therefore, the user cost can be cut down.

Control of the reverse feed job in the sheet both-sheet feed mode will be described below.

Figure 14:
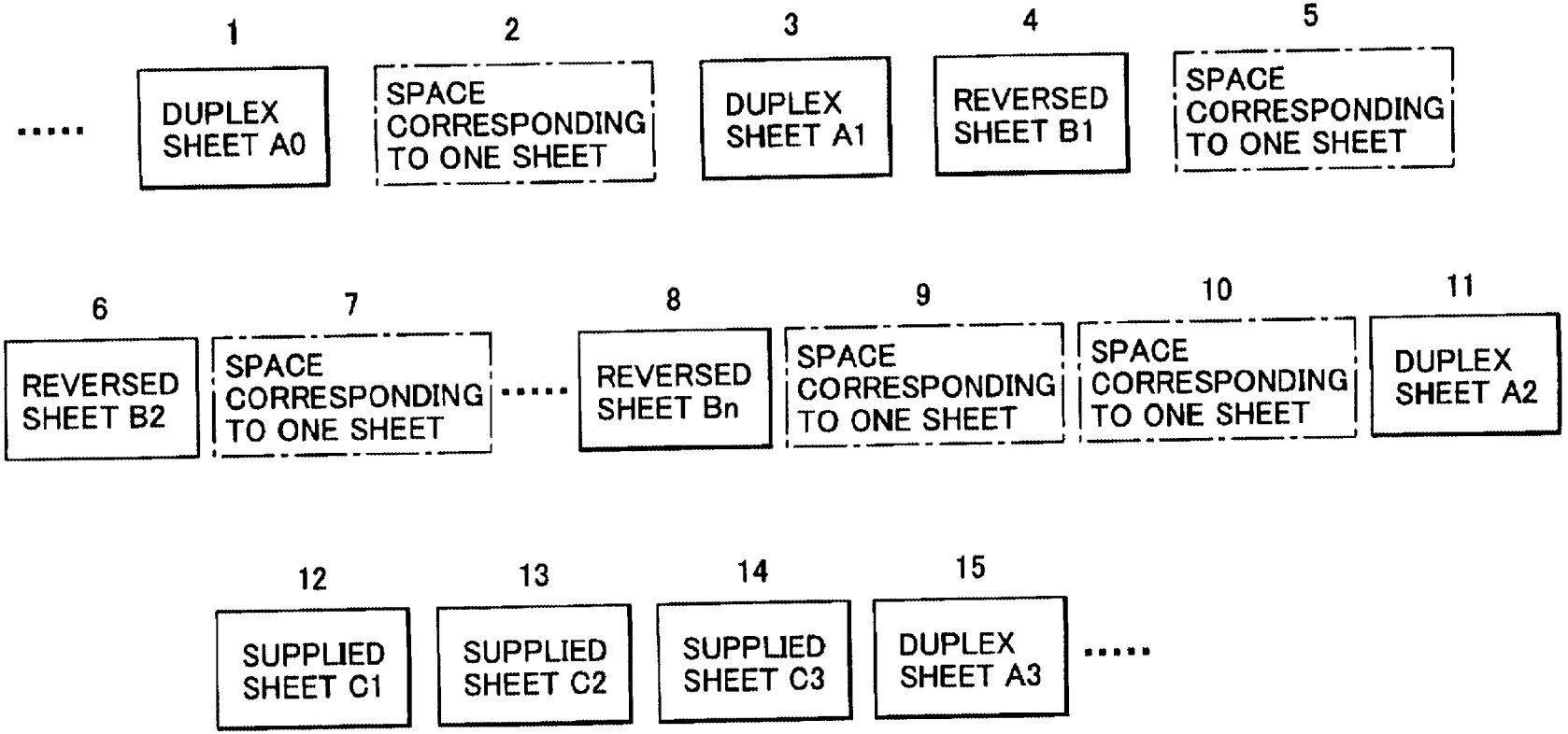
FIG. 14 is a diagram showing the sequence in which sheets are transported to an in-register introducing section when a reverse feed job is performed in the duplex feed unit.

In this embodiment, when executing the reverse feed job, a space corresponding to one sheet is left after a sheet that is to be ejected after being reversed. FIG. 14 showing the sequence in which sheets are transported to the in-register introducing section 116 when the reverse feed job is performed.

Referring to FIG. 14, "A" represents a duplex sheet (denoted by "TWO-SIDED SHEET" in the drawing) that is one having an image already formed on one side and resupplied from the duplex feed unit 201, and "B" represents a reversed sheet (denoted by "REVERSED SHEET" in the drawing) that is one to be ejected after being reversed. Further, "C" represents a supplied sheet that is one just supplied from one of the sheet supply cassettes.

As shown in FIG. 14, when ejecting reversed sheets B1 to Bn subsequent to a two-sided sheet A1, the sheets are transported to the in-register introducing section 116 in such a sequence that when a two-sided sheet A0 preceding the two-sided sheet A1 is transported to the in-register introducing section 116, a space corresponding to one sheet is left after the two-sided sheet A0 (as indicated by "SPACE CORRESPONDING TO ONE SHEET" in the drawing).

Subsequently, there follows the two-sided sheet A1, the reversed sheet B1, a space corresponding to one sheet, the reversed sheet B2, and a space corresponding to one sheet in that order. Then, the subsequent reversed sheets are transported by repeating such an alternate sequence. After the final reversed sheet Bn, there follows a space corresponding to two sheets, the two-sided sheet A2, three sheets supplied from the sheet supply cassette, and the two-sided sheet A3 in that order.

Figure 15A:
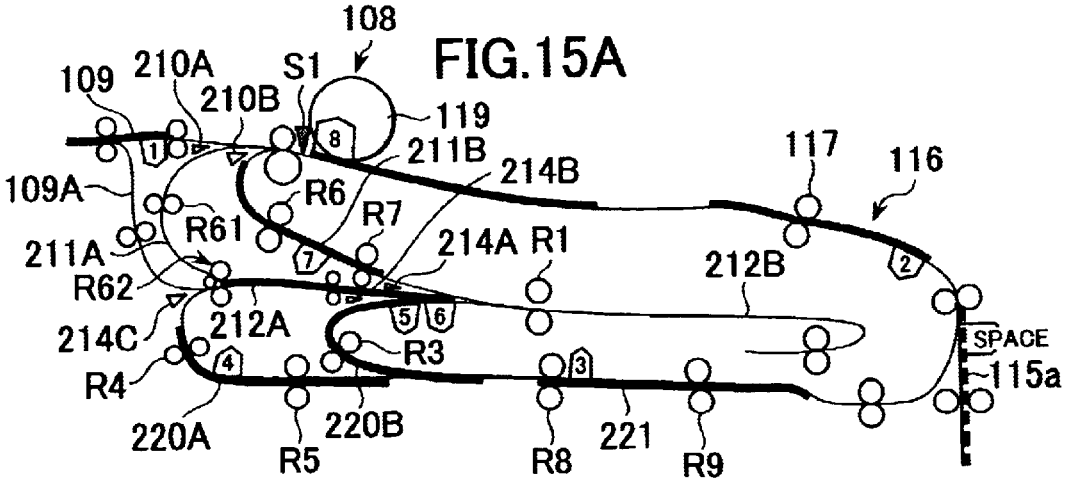
FIGS. 15A, 15B and 15C are a first set of schematic views for explaining a flow of sheets in the reverse feed job.

Such a flow of the sheets will be described below in more detail. As an actual sheet flow, a description is made of the case of ejecting three sheets just after reversing them subsequent to the third sheet No. 3 in the state of FIG. 12A, and then returning again to the duplex feed. In FIG. 12B, after transporting the second sheet No. 2 from the re-feed path 221 to the feed path 115*a*, the ninth sheet No. 9 is supplied from one of the sheet supply cassettes 113A, 113B, 113C and 113D. In this embodiment, however, a space corresponding to one sheet is left subsequent to the second sheet No. 2 as shown in FIG. 15A (as indicated by "SPACE" in the drawing and a dotted line corresponding to the sheet length).

While a space corresponding to one sheet is left subsequent to the second sheet No. 2, the third sheet No. 3 is transported from the second reverse feed path 220B to the re-feed path 221 at the timing of re-supplying it to the feed path 115*a*. The fourth to sixth sheets Nos. 4 to 6 are in the standby state in the respective downstream feed paths, and therefore they are kept in that state.

For the seventh sheet No. 7, since the second switchback path 212B on the downstream side is vacant, the seventh sheet No. 7 is advanced from the second reverse inlet feed path 211B to the second switchback path 212B. For the eighth sheet No. 8, when the leading end of the eighth sheet No. 8 has passed the fusing roller pair 119 and it is detected by the first sensor S1, the controller controls the first and second sheet ejection flappers 210A, 210B so as to transport the eighth sheet No. 8 to the second reverse inlet feed path 211B in order that the reversed sheet transported subsequent to the eighth sheet No. 8 is transported for reverse through one of the first reverse inlet feed path 211A and the second reverse inlet feed path 211B, e.g., through the first reverse inlet feed path 211A in this embodiment.

Figure 15B:
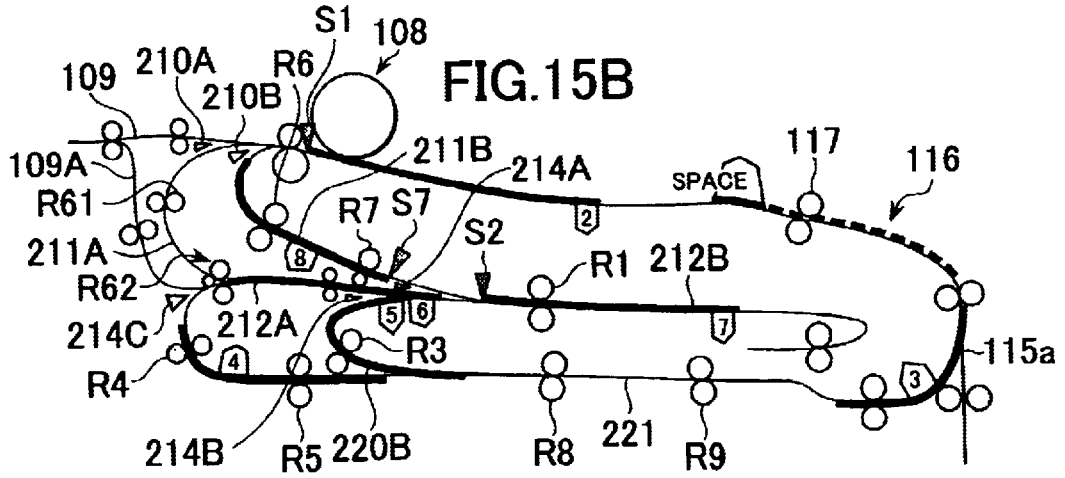

As a result, as shown in FIG. 15B, the eighth sheet No. 8 is transported to the second reverse inlet feed path 211B, and the third sheet No. 3 is transported from the re-feed path 221 to the feed path 115*a* after leaving a space corresponding to one sheet subsequent to the second sheet No. 2. The fourth to sixth sheets Nos. 4 to 6 are still kept in the standby state. Also, when the second sensor S2 in the second switchback path 212B detects the tailing end of the seventh sheet No. 7, the driving of the roller pair R1 is stopped to cease the transport of the seventh sheet No. 7 temporarily.

Further, when the seventh sensor S7 provided in the second reverse inlet feed path 211B detects the leading end of the eighth sheet No. 8, the driving of the roller pairs R6, R7 is stopped to cease the transport of the eighth sheet No. 8 temporarily because it is known that the seventh sheet No. 7 is still present in the second switchback path 212B on the downstream side. On the other hand, when the first sensor S1 detects the leading end of the second sheet No. 2, the controller controls the first and second sheet ejection flappers 210A, 210B so as to eject the second sheet No. 2 out of the machine.

Figure 15C:
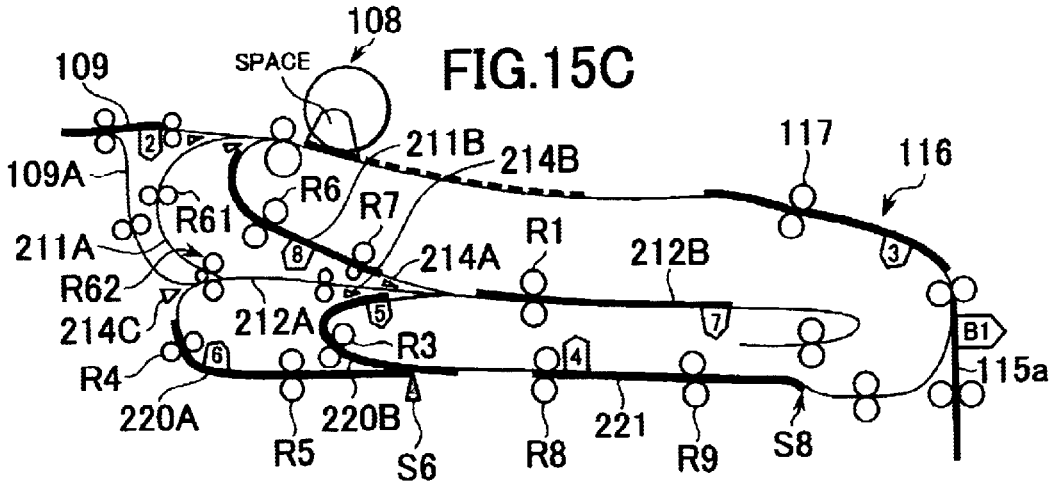

As a result, as shown in FIG. 15C, the second sheet No. 2 is ejected out of the machine through the first sheet ejection path 109. Also, a first reversed sheet B1 is transported to the feed path 115*a* subsequent to the third sheet No. 3 having reached the in-register introducing section 116. Additionally, when the eighth sensor S8 provided in the re-feed path 221 detects the leading end of the fourth sheet No. 4, the driving of the roller pairs R8, R9 is stopped to cease the transport of the fourth sheet No. 4 temporarily.

Simultaneously, the sixth sheet No. 6 is transported from the first switchback path 212A to the first reverse feed path 220A. When the sixth sensor S6 detects the leading end of the sixth sheet No. 6, the driving of the roller pairs R4, R5 is stopped to cease the transport of the sixth sheet No. 6 temporarily because the fourth sheet No. 4 is present on the downstream side of the re-feed path 221.

With the control described above, the first reverse inlet feed path 211A, the first switchback path 212A and the second sheet ejection path 109A can be made vacant which are required for ejecting a sheet just after reversing it. The fifth sheet No. 5, the seventh sheet No. 7 and the eighth sheet No. 8 are still kept in the standby state.

Figure 16A:
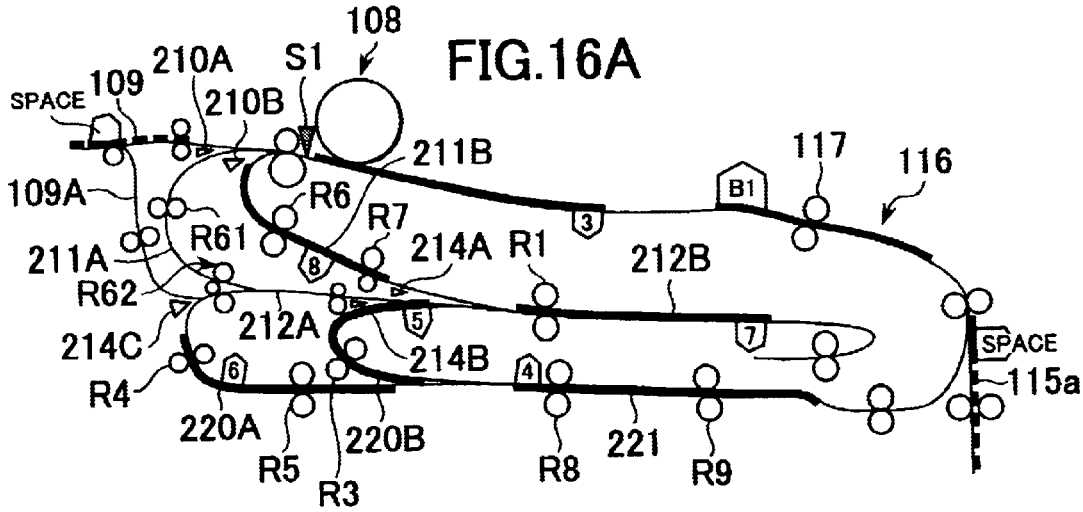
FIGS. 16A, 16B and 16C are a second set of schematic views for explaining a flow of sheets in the reverse feed job.

Then, as shown in FIG. 16A, when the first sensor S1 detects the leading end of the third sheet No. 3, the controller controls the first and second sheet ejection flappers 210A, 210B so as to transport the third sheet No. 3 to the first sheet ejection path 109 for ejecting it out of the machine. The fourth to eighth sheets Nos. 4 to 8 are still kept in the standby state. In addition, a space corresponding to one sheet is left subsequent to the first reversed sheet No. 1.

Figure 16B:
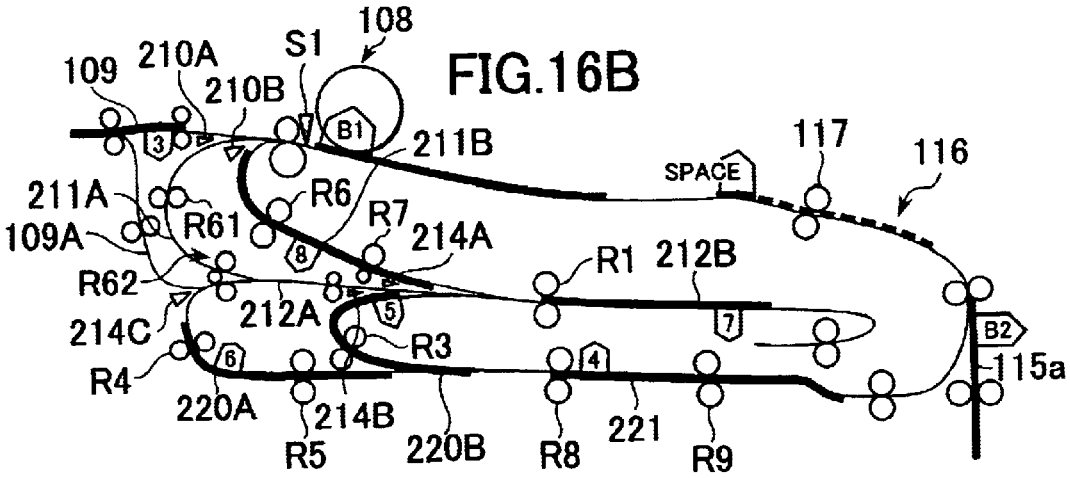

Then, as shown in FIG. 16B, the third sheet No. 3 is transported to the first sheet ejection path 109. Also, when the first sensor S1 detects the leading end of the first reversed sheet B1, the controller controls the first and second sheet ejection flappers 210A, 210B so as to transport the first reversed sheet B1 to the first reverse inlet feed path 211A. Further, a second reversed sheet B2 supplied after leaving a space corresponding to one sheet subsequent to the first reversed sheet B1 is transported to the feed path 115*a*. The fourth to eighth sheets Nos. 4 to 8 are still kept in the standby state.

Figure 16C:
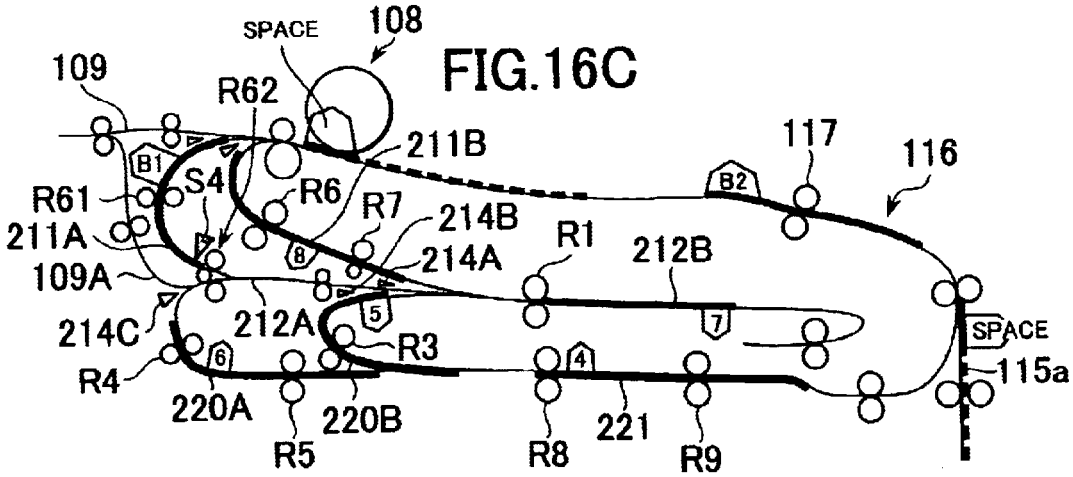

Then, as shown in FIG. 16C, when the fourth sensor S4 detects the leading end of the first reversed sheet B1 transported to the first reverse inlet feed path 211A, the first reversed sheet B1 is continuously transported because it is known that there is no preceding sheet in the first switchback path 212A on the downstream side. Further, a space corresponding to one sheet is left subsequent to the second reversed sheet B2. The fourth to eighth sheets Nos. 4 to 8 are still kept in the standby state.

Figure 17A:
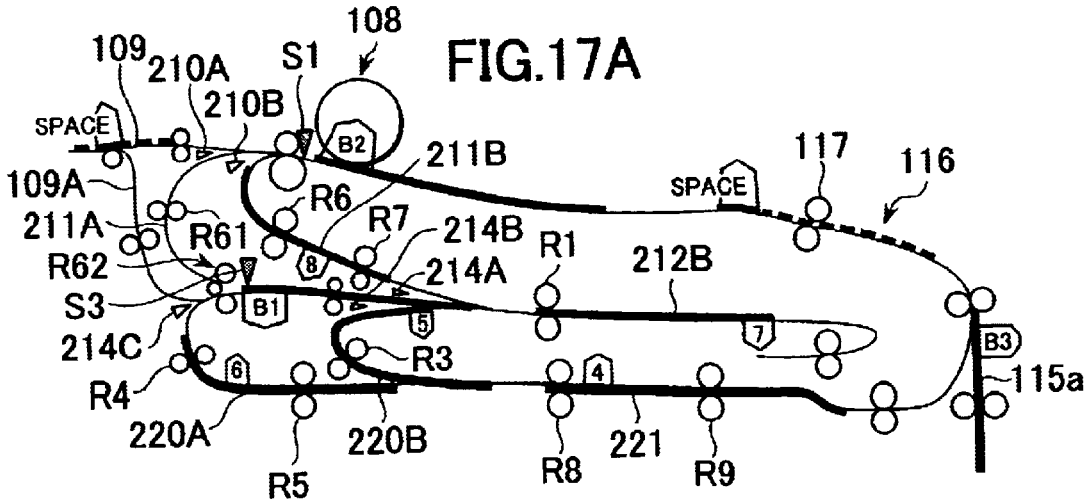
FIGS. 17A, 17B and 17C are a third set of schematic views for explaining a flow of sheets in the reverse feed job.

Then, as shown in FIG. 17A, when the third sensor S3 provided in the first switchback path 212A detects the tailing end of the first reversed sheet B1, the driving of the roller pair R2 is stopped to temporarily cease the transport of the first reversed sheet B1. After stopping the roller pair R2 for a predetermined time until specific vibrations of the stepping motor are stabilized, the roller pair R2 is driven to rotate in the backward direction. Then, when the third sensor S3 detects the leading end of the first reversed sheet B1 transported backward, the controller controls the third and fourth flappers 214C, 214D so as to transport the first reversed sheet B1 to the second sheet ejection path 109A.

As with the first reversed sheet B1, when the first sensor S1 detects the leading end of the second reversed sheet B2, the controller controls the first and second sheet ejection flappers 210A, 210B so as to transport the second reversed sheet B2 to the first reverse inlet feed path 211A. Further, a third reversed sheet B3 is supplied from one of the sheet supply cassettes 113A, 113B, 113C and 113D after leaving a space corresponding to one sheet subsequent to the second reversed sheet B1 and transported through the feed path 115*a*. The fourth to eighth sheets Nos. 4 to 8 are still kept in the standby state.

Figure 17B:
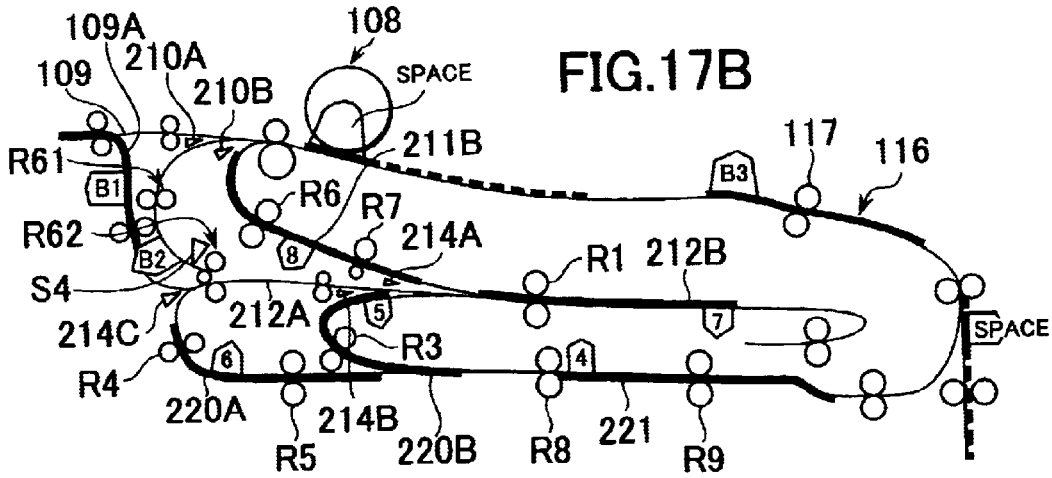

Then, as shown in FIG. 17B, the first reversed sheet B1 is ejected out of the machine through the second sheet ejection path 109A. Also, when the fourth sensor S4 detects the leading end of the second reversed sheet B2 transported to the first reverse inlet feed path 211A, the second reversed sheet B2 is continuously transported because it is known that there is no preceding sheet in the first switchback path 212A on the downstream side.

All the three reversed sheets have been thus supplied, but any sheet is not supplied immediately after this point in time from any of the sheet supply cassettes 113A, 113B, 113C and 113D or from the re-feed path 221. The fourth to eighth sheets Nos. 4 to 8 are still kept in the standby state.

Figure 17C:
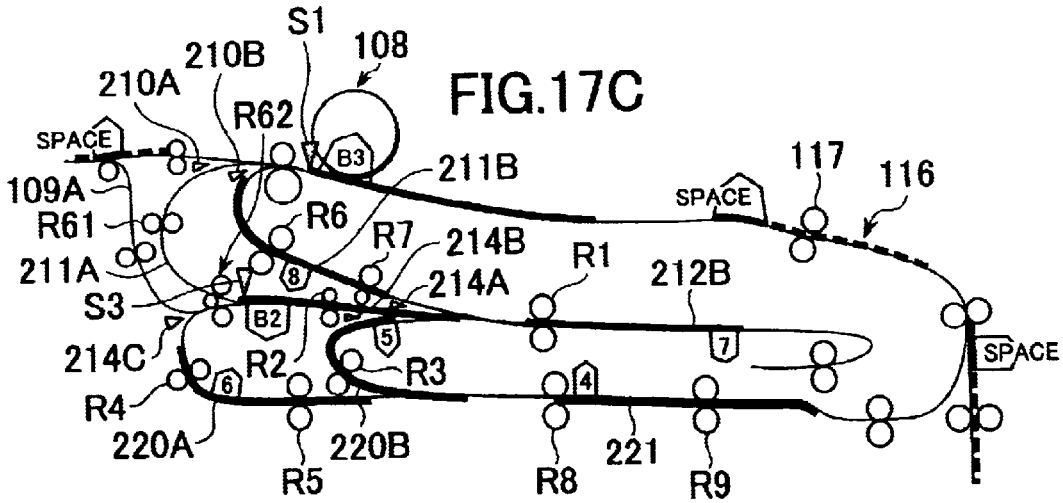

Then, as shown in FIG. 17C, when the third sensor S3 provided in the first switchback path 212A detects the tailing end of the second reversed sheet B2, the driving of the roller pair R2 is stopped to cease the transport of the second reversed sheet B2 temporarily. After stopping the roller pair R2 for a predetermined time, the roller pair R2 is driven to rotate in the backward direction. Then, when the third sensor S3 detects the leading end of the second reversed sheet B2 transported backward, the controller controls the third and fourth flappers 214C, 214D so as to transport the second reversed sheet B2 to the second sheet ejection path 109A.

As with the first and second reversed sheets B1 and B2, when the first sensor S1 detects the leading end of the third reversed sheet B3, the controller controls the first and second sheet ejection flappers 210A, 210B so as to transport the third reversed sheet B3 to the first reverse inlet feed path 211A. At this time, similarly to the above step, any sheet is not supplied from any of the sheet supply cassettes 113A, 113B, 113C and 113D or from the re-feed path 221.

Then, as shown in FIG. 18A, the second reversed sheet B2 is ejected out of the machine through the second sheet ejection path 109A. Also, when the fourth sensor S4 detects the leading end of the third reversed sheet B3 transported to the first reverse inlet feed path 211A, the third reversed sheet B3 is continuously transported because it is known that there is no preceding sheet in the first switchback path 212A on the downstream side. Further, the fourth sheet No. 4 is transported from the re-feed path 221 to the feed path 115*a* at the timing of causing the fourth sheet to be transported with a space corresponding to two sheets left after supply of the third reversed sheet B3 that is a final one of the reversed sheets.

Figure 18B:
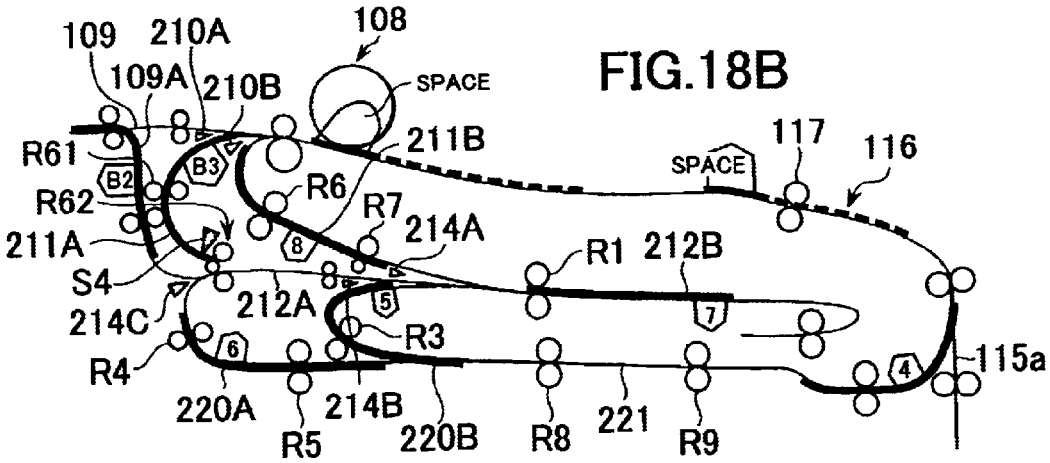
Figure 18B:
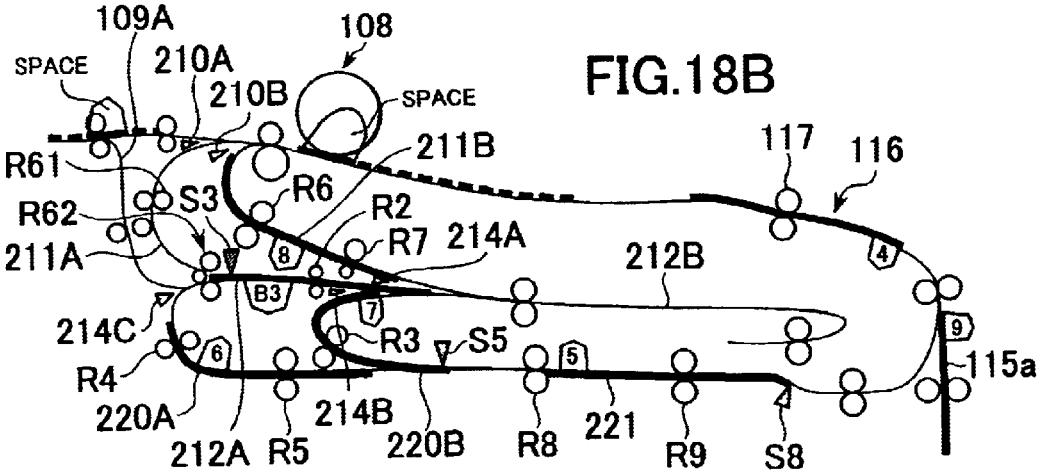

Then, as shown in FIG. 18B, when the third sensor S3 provided in the first switchback path 212A detects the tailing end of the third reversed sheet B3, the driving of the roller pair R2 is stopped to temporarily cease the transport of the third reversed sheet B3. After stopping the roller pair R2 for a predetermined time, the roller pair R2 is driven to rotate in the backward direction to transport the third reversed sheet B3 backward. Then, when the third sensor S3 detects the leading end of the third reversed sheet B3 transported backward, the controller controls the third and fourth flappers 214C, 214D so as to transport the third reversed sheet B3 to the second sheet ejection path 109A.

Additionally, the ninth sheet No. 9 is supplied from any of the sheet supply cassettes 113A, 113B, 113C and 113D and transported through the feed path 115*a* so as to follow the fourth sheet No. 4 that has been re-supplied from the re-feed path 221. Thereafter, three sheets, including the ninth sheet No. 9, are supplied from any of the sheet supply cassettes 113A, 113B, 113C and 113D to fill a space corresponding to three sheets, i.e., the number of the first to third reversed sheets B1 to B3, which space has been caused in the copying machine 100 for reversing those reversed sheets.

For the fifth sheet No. 5, since there is no preceding sheet in the re-feed path 221 on the downstream side, the fifth sheet is advanced to the re-feed path 221 to be transported after the ninth to eleventh sheets No. 9 to 11. Then, when the eighth sensor S8 provided in the re-feed path 221 detects the leading end of the fifth sheet No. 5, the driving of the roller pairs R8, R9 is stopped to temporarily cease the transport of the fifth sheet No. 5.

Simultaneously, the seventh sheet No. 7 is transported from the second switchback path 212B to the second reverse feed path 220B. When the fifth sensor S5 detects the leading end of the seventh sheet No. 7, the driving of the roller pair R3 is stopped to temporarily cease the transport of the seventh sheet No. 7 because the sixth sheet No. 6 is standing by in the first reverse feed path 220A.

Figure 18C:
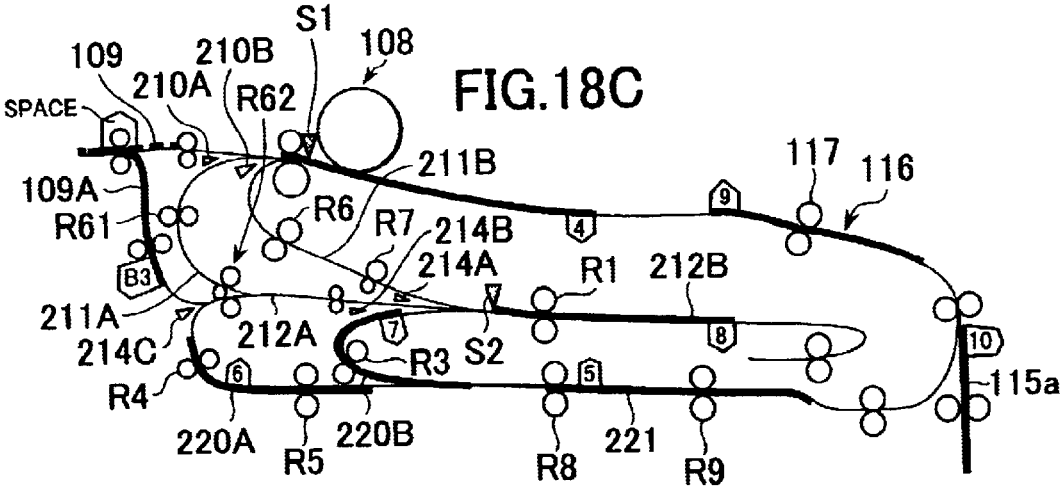

Then, as shown in FIG. 18C, the third reversed sheet B3 is ejected out of the machine through the second sheet ejection path 109A. Also, when the first sensor S1 detects the leading end of the fourth sheet No. 4, the controller controls the first and second sheet ejection flappers 210A, 210B so as to eject the fourth sheet No. 4 out of the machine through the first sheet ejection path 208A. The sixth and seventh sheets Nos. 6 and 7 are still kept in the standby state.

Also, the transport of the eighth sheet No. 8 is started because there is no preceding sheet in the second switchback path 212B on the downstream side, and the driving of the roller pair R1 is completed. Thereafter, when the second sensor S2 detects the tailing end of the eighth sheet No. 8, the driving of the roller pair R1 is stopped. Further, the tenth sheet No. 10 is supplied from any of the sheet supply cassettes 113A, 113B, 113C and 113D and transported to the feed path 115*a*.

Figure 19A:
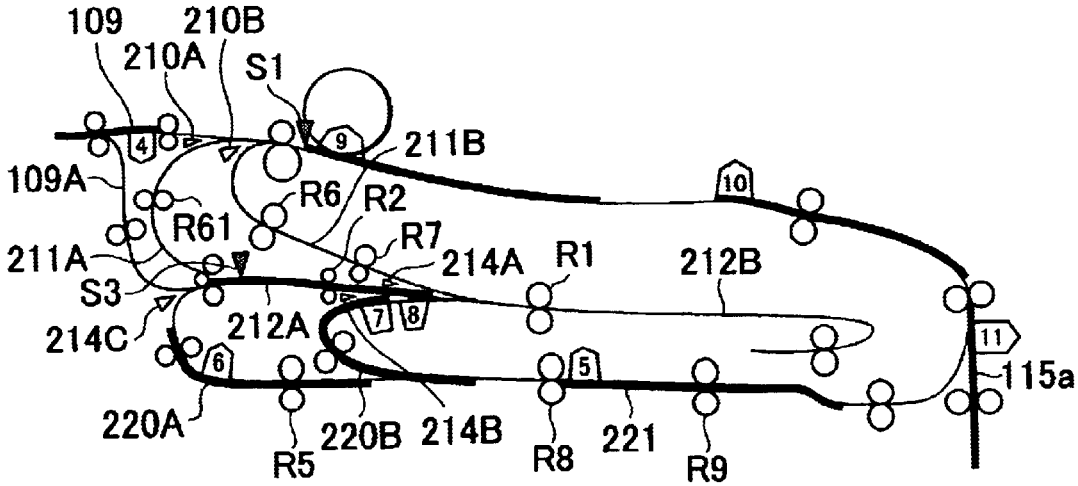
FIGS. 19A and 19B are a fifth set of schematic views for explaining a flow of sheets in the reverse feed job.

Then, as shown in FIG. 19A, the fourth sheet No. 4 is ejected out of the machine through the first sheet ejection path 109. The fifth to seventh sheets Nos. 5 to 7 are still kept in the stopped state. Also, while the eighth sheet No. 8 has been advanced from the second reverse inlet feed path 211B to the second switchback path 212B for the purpose of ejecting the reverses sheets just after reversing them in spite of the fact that the eighth sheet No. 8 is one of the 2n-th sheets. Therefore, the controller controls the first and second flappers 214A, 214B so that the fourth sheet No. 4 is transported to the first switchback path 212A from the second switchback path 212B.

Then, when the third sensor S3 detects the leading end of the eighth sheet No. 8 transported to the first switchback path 212A, the controller controls the third and fourth flappers 214C, 214D so as to transport the eighth sheet No. 8 downstream, i.e., to the first reverse sheet feed path 220A.

At this time, however, since the preceding sheet is present in the first reverse sheet feed path 220A, the driving of the roller pair R2 is stopped to temporarily cease the transport of the eighth sheet No. 8. Also, when the first sensor S1 detects the leading end of the ninth sheet No. 9, the controller controls the first and second sheet ejection flappers 210A, 210B so as to transport the eighth sheet No. 8 to the second reverse inlet feed path 211B. Further, the eleventh sheet No. 11 is supplied from any of the sheet supply cassettes 113A, 113B, 113C and 113D and transported to the feed path 115*a*.

Figure 19B:
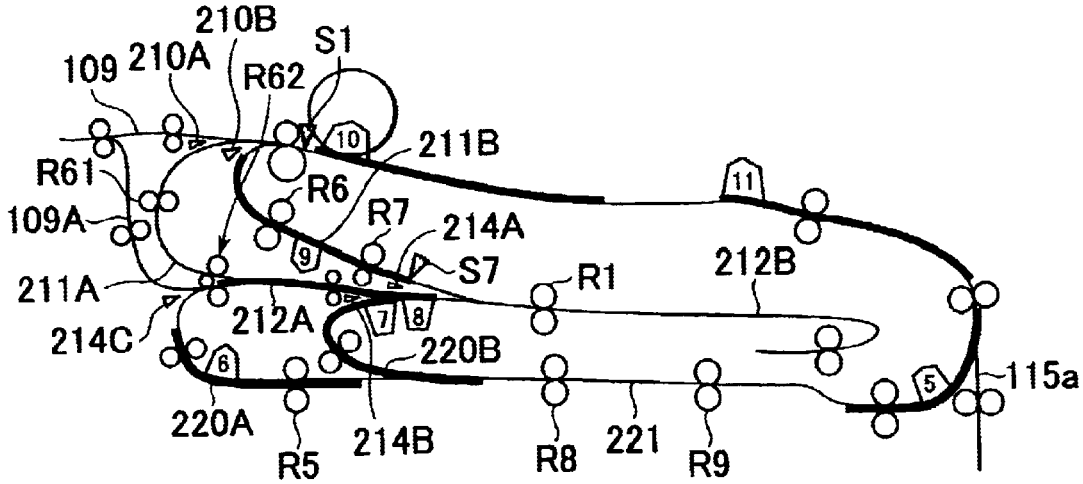

Then, as shown in FIG. 19B, the fifth sheet No. 5 is transported to the feed path 115*a* subsequent to the eleventh sheet No. 11 that has been supplied from any of the sheet supply cassettes 113A, 113B, 113C and 113D. The sixth to eighth sheets Nos. 6 to 8 are still kept in the standby state.

Also, when the seventh sensor S7 detects the leading end of the ninth sheet No. 9 transported to the second reverse inlet feed path 211B, the controller confirms whether any preceding sheet is present in the second switchback path 212B on the downstream side. In this case, since it is confirmed that there is no preceding sheet, the ninth sheet No. 9 is continuously transported. For the tenth sheet No. 10, when the first sensor S1 detects the leading end of the tenth sheet No. 10, the controller controls the first and second sheet ejection flappers 210A, 210B so as to transport the tenth sheet No. 10 to the first reverse inlet feed path 211A.

Thereafter, the sequence of the sheet duplex feed is executed by carrying out the steps from FIG. 11C to FIG. 13B and then repeating again the steps from FIG. 11C to FIG. 13B.

Thus, in the duplex feed job, the use of one of the first and second reverse inlet feed paths 211A, 211B and one of the first and second switchback paths 212A, 212B, i.e., the first reverse inlet feed path 211A and the first switchback path 212A in this embodiment which are positioned closer to the second sheet ejection path 109A, is prevented to thereby form a reverse ejection feed path for reversing a sheet through the first reverse inlet feed path 211A and the first switchback path 212A and then advancing it to the second sheet ejection path 109A. Further, two-sided sheets are controlled to stand by in respective standby points within the copying machine. With such an arrangement, even in the duplex feed mode, sheets can be ejected just after reversing them by employing the first reverse inlet feed path 211A and the first switchback path 212A.

Accordingly, the reverse feed job can be performed even in the duplex feed mode, and high productivity can be realized. Further, since sheets corresponding to one-sided documents are ejected just after being reversed, without supplying the sheets again to the image forming section 105, it is possible to save energy consumed and to reduce the cost.

The above description is made in connection with the case of forming the reverse ejection feed path by the first reverse inlet feed path 211A and the first switchback path 212A which are positioned closer to the second sheet ejection path 109A. However, the reverse ejection feed path may be formed by the second reverse inlet feed path 211B and the second switchback path 212B. When forming the reverse ejection feed path by the second reverse inlet feed path 211B and the second switchback path 212B, a space corresponding to one sheet is left prior to the reversed sheet.

Also, while the above description is made in connection with a copying machine including two reverse inlet feed paths, the present invention is not limited to such an arrangement, and three or more reverse inlet feed paths may be provided. When providing three or more reverse inlet feed paths, a space corresponding to two or more sheets is left before or after each reversed sheet so that the reversed sheet can be transported to a selected one of the reverse inlet feed paths.

Further, while the above description is made in connection with the feed control of short-sized sheets, the present invention is not limited to that control. By changing the timing (sheet interval), at which sheets are transported to the in-register introducing section 106, depending on sheet sizes and altering the number of sheets circulated in the copying machine, similar operation to that described above can be performed for not only short-sized sheets (such as A4, LTR and B5), but also large sized sheets (such as A3, LDR, LGL and B4) and R-series sheets (such as A4R, LTR-R and B5R).

In the above description, a stepping motor is used as the driving source for sheet feed, but a clutch may also be used instead of the stepping motor.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

What is claimed is:

1. An image forming apparatus adapted to reverse a sheet on one side of which an image has been formed in an image forming section, transport the sheet back to said image forming section, and form an image on a second side of the sheet, the apparatus comprising:

an inlet feed path for transporting a sheet, on one side of which an image has been formed;

a switchback path for withdrawing the sheet transported from said inlet feed path;

a plurality of reverse feed paths each branching from said switchback path at one of plural positions, each of said plurality of reverse feed paths transporting a sheet while reversing the sheet; and a re-feed path for transporting the reversed sheet from any of said plurality of reverse feed paths back to said image forming section.

2. An image forming apparatus according to claim 1, wherein after the sheet is withdrawn into said switchback path, the sheet is transported backward, selectively transferred to one of said plurality of reverse feed paths, and transported through the selected reverse feed path, whereby the sheet is transported to said re-feed path after being reversed.

3. An image forming apparatus according to claim 2, further comprising a plurality of reversible sheet feed means for transporting a sheet to said switchback path, wherein the sheet is transported into said switchback path with forward rotation of said sheet feed means, and thereafter the sheet having been transported into said switchback path is transported to one of said plurality of reverse feed paths with backward rotation of said sheet feed means.

4. An image forming apparatus according to claim 2, wherein while a preceding sheet is transported in a reverse direction in each of said plurality of reverse feed paths, a succeeding sheet transported from said inlet feed path is transported in a direction in which the succeeding sheet is withdrawn into said switchback path, such that the preceding sheet and the succeeding sheet pass each other at a branch position in which said reverse feed path is branched from said switchback path.

5. An image forming apparatus according to claim 4, further comprising a plurality of roller pairs provided in said switchback path and each pair contactable with each other and moveable apart from each other, wherein when a sheet transported into said switchback path is transported to said reverse feed path, said pair of rollers are moved apart from each other, thereby enabling the preceding sheet and the succeeding sheet to pass each other at said branch position.

6. An image forming apparatus according to claim 1, wherein said switchback path is disposed linearly and substantially parallel to a sheet feed direction as the sheet leaves said image forming section, and said re-feed path is disposed linearly and substantially parallel to said switchback path, said inlet feed path transporting a sheet to said switchback path after reversing the sheet and said plurality of reverse feed paths transporting respective sheets to said re-feed path after reversing the sheets.

7. An image forming apparatus according to claim 6, wherein said switchback path and said re-feed path are disposed substantially in a horizontal direction.

8. An image forming apparatus according to claim 1, further comprising control means for controlling sheet transport such that sheets successively transported to said switchback path at a predetermined interval are distributed to said plurality of reverse feed paths in a predetermined order and are transported to said re-feed path in a predetermined feed order.

9. An image forming apparatus according to claim 8, wherein said control means includes means for controlling and temporarily stopping a sheet transported in said switchback path and a sheet transported in said re-feed path.

10. An image forming apparatus according to claim 9, wherein, under control of said control means, succeeding sheets are stopped temporarily in said plurality of reverse feed paths while a sheet is stopped temporarily in said re-feed path, and after the sheet in said re-feed path has been transported out of said re-feed path, the temporarily stopped sheets in said plurality of reverse feed paths are transported to said re-feed path in the predetermined feed order.

11. An image forming apparatus according to claim 9, wherein, under control of said control means, sheets stopped in said plurality of reverse feed paths are transported to said re-feed path in the predetermined feed order at an interval shorter than a predetermined interval between the sheets transported to said switchback path.

12. An image forming apparatus according to claim 1, further comprising control means for changing an interval between sheets, which are successively transported to said switchback path, depending on a sheet length in a sheet feed direction.

13. An image forming apparatus according to claim 1, wherein said inlet feed path is provided in plural, and each inlet feed path merges with said switchback path.

14. An image forming apparatus according to claim 13, wherein after transporting a sheet to said switchback path from one of said plurality of inlet feed paths and withdrawing the sheet into said switchback path, the sheet is transported in a reverse direction, selectively transferred to one of said plurality of reverse feed paths, and transported through the selected reverse feed path, whereby the sheet is transported to said re-feed path after being reversed.

15. An image forming apparatus according to claim 14, further comprising a plurality of reversible sheet feed means for transporting a sheet to said switchback path from one of said plurality of inlet feed paths, wherein the sheet is transported into said switchback path with forward rotation of said sheet feed means, and thereafter the sheet having been transported into said switchback path is transported to one of said plurality of reverse feed paths with backward rotation of said sheet feed means.

16. An image forming apparatus according to claim 13, wherein said switchback path is disposed linearly and substantially parallel to a sheet feed direction in said image forming section and said re-feed path is disposed linearly and substantially parallel to said switchback path, wherein said plurality of inlet feed paths transport respective sheets to said switchback path after reversing the sheets and said plurality of reverse feed paths transport respective sheets to said re-feed path after reversing the sheets.

17. An image forming apparatus according to claim 16, wherein said switchback path and said re-feed path are disposed substantially in a horizontal direction.

18. An image forming apparatus according to claim 13, further comprising control means for controlling transport of the sheets to successively transported the sheets from said plurality of inlet feed paths, and successively transport the sheets from said plurality of reverse feed paths to said re-feed path in the same order as that in which the sheets have been transported from said plurality of inlet feed paths to said switchback path.

19. An image forming apparatus according to claim 18, wherein said control means further controls the sheets successively transported to said plurality of inlet feed paths to stand by in said plurality of inlet feed paths, said switchback path, said plurality of reverse feed paths and said re-feed path in predetermined order, and the standing-by sheets are then transported to said re-feed path at predetermined timing in predetermined order.

20. An image forming apparatus according to claim 19, further comprising a sheet feed path provided between a sheet container containing sheets which are not yet subjected to image formation and said image forming section, and merging with said re-feed path, wherein said control means further controls the sheet standing by in said re-feed path to be transported to said sheet feed path after sheets in number capable of standing by in said plurality of inlet feed paths, said switchback path, said plurality of reverse feed paths and said re-feed path have been transported to the side downstream of a merging portion of said sheet feed path and said re-feed path.

21. An image forming apparatus according to claim 20, wherein said control means further controls the sheets so that after transporting the sheet standing by in said re-feed path to said sheet feed path, a sheet contained in said sheet container is transported to said sheet feed path before a next standing sheet is transported to said sheet feed path, whereby the sheet, which is not yet subjected to image formation and the standing-by sheet are alternately transported.

22. An image forming apparatus according to claim 13, further comprising a first sheet ejection path for ejecting a sheet having an image formed on one side immediately after image formation, and a second sheet ejection path for ejecting a sheet having an image formed on one side after reversing the sheet, wherein a sheet is reversed through a predetermined one of said plurality of inlet feed paths and said switchback path, and the reversed sheet is ejected through said second sheet ejection path.

23. An image forming apparatus according to claim 22, further comprising control means for controlling sheet feed interval such that a space corresponding to at least one sheet is left before or after the sheet that is transported through said second sheet ejection path after being reversed.

24. An image forming apparatus according to claim 22, further comprising a sheet feed path provided between a sheet container containing sheets which are not yet subjected to image formation and said image forming section, and merging with said re-feed path, and control means for, after sheets each having an image formed on one side have been ejected after being reversed, transporting sheets to said sheet feed path in the same number as that of the sheets which have been ejected after being reversed.

25. An image forming apparatus according to claim 13, further comprising control means for changing an interval between the transported sheets depending on a sheet length in a sheet feed direction.

26. An image forming apparatus adapted to reverse a sheet on one side of which an image has been formed in an image forming section, transport the sheet back to said image forming section, and form an image on a second side of the sheet, the apparatus comprising:

a reverse inlet feed path for transporting a sheet, on one side of which an image has been formed in said image forming section, while reversing the sheet;

a linear switchback path for withdrawing the sheet transported from said reverse inlet feed path;

a plurality of reverse feed paths each branching from said switchback path at one of plural positions, each of said plurality of reverse feed paths transporting a sheet while reversing the sheet;

a linear re-feed path provided substantially parallel to said switchback path and transporting the reversed sheet from any of said plurality of reverse feed paths back to said image forming section; and flappers provided at respective positions where said plurality of reverse feed paths are branched from said switchback path, said flappers positioned to selectively guide the sheets from said switchback path to said plurality of reverse feed paths.

27. An image forming apparatus according to claim 26, further comprising a plurality of reverse inlet feed paths for transporting respective sheets, on one side of each of which an image has been formed in said image forming section, to said switchback path after reversing the sheet; and flappers for selectively guiding the sheets, on one side of each of which an image has been formed, to said plurality of reverse inlet feed paths.

28. An image forming apparatus according to claim 27, wherein said switchback path and said re-feed path are disposed substantially in a horizontal direction.

29. An image forming apparatus according to claim 26, wherein said switchback path and said re-feed path are disposed substantially in a horizontal direction.

* * * * *

UNITED STATES PATENT AND TRADEMARK OFFICE

CERTIFICATE OF CORRECTION

PATENT NO. : 6,782,236 B2
DATED : August 24, 2004
INVENTOR(S) : Ichiro Sasaki et al.

It is certified that error appears in the above-identified patent and that said Letters Patent is hereby corrected as shown below:

Drawings,
Sheet No. 18, Figures 18B and 18C, "FIG. 18B" (1st occurrence) should read -- FIG. 18A --.

Column 1,
Line 38, "duplexs" should read -- duplexes --.

Column 5,
Line 13, "a" should read -- the --.
Line 14, "directions of" should read -- direction of the --.

Column 11,
Line 8, "109," should read -- 110, --.

Column 13,
Line 5, "is" should read -- are --.

Column 14,
Line 3, "to" should read -- too --.
Line 10, "eight" should read -- eighth --.

Column 16,
Line 49, "a" should be deleted.

Column 17,
Line 16, "showing" should read -- shows --.

Column 21,
Line 13, "reverses" should read -- reversed --.

UNITED STATES PATENT AND TRADEMARK OFFICE

CERTIFICATE OF CORRECTION

PATENT NO. : 6,782,236 B2
DATED : August 24, 2004
INVENTOR(S) : Ichiro Sasaki et al.

It is certified that error appears in the above-identified patent and that said Letters Patent is hereby corrected as shown below:

Column 24,
Line 42, “transported” should read -- transport --.
Line 65, “have” should read -- having --.

Column 25,
Line 19, “sheet” should read -- a sheet --.

Signed and Sealed this

Fourteenth Day of December, 2004

JON W. DUDAS
*Director of the United States Patent and Trademark Office*